US009091948B2

(12) United States Patent
Shirasuna et al.

(10) Patent No.: US 9,091,948 B2
(45) Date of Patent: Jul. 28, 2015

(54) ELECTROPHOTOGRAPHIC PHOTOSENSITIVE MEMBER, METHOD FOR MANUFACTURING THE SAME, AND ELECTROPHOTOGRAPHIC APPARATUS

(71) Applicant: CANON KABUSHIKI KAISHA, Tokyo (JP)

(72) Inventors: Toshiyasu Shirasuna, Mishima (JP); Yuu Nishimura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/182,599

(22) Filed: Feb. 18, 2014

(65) Prior Publication Data

US 2014/0242506 A1 Aug. 28, 2014

(30) Foreign Application Priority Data

Feb. 22, 2013 (JP) ..... 2013-033648

(51) Int. Cl.

*G03G 5/08* (2006.01)
*G03G 5/043* (2006.01)
*G03G 5/082* (2006.01)
(Continued)

(52) U.S. Cl.

CPC ..... *G03G 5/043* (2013.01); *G03G 5/0433* (2013.01); *G03G 5/0525* (2013.01); *G03G 5/08* (2013.01); *G03G 5/08214* (2013.01);
(Continued)

(58) Field of Classification Search

CPC ..... G03G 5/142; G03G 5/144; G03G 5/14; G03G 5/08235
USPC ..... 430/64, 65
See application file for complete search history.

(56) References Cited

U.S. PATENT DOCUMENTS 4,569,855 A 2/1986 Matsuda et al.
4,683,144 A 7/1987 Nishimura et al.
(Continued)

FOREIGN PATENT DOCUMENTS

EP 1 253 473 A2 10/2002
JP 05-289464 A 11/1993
(Continued)

OTHER PUBLICATIONS

Machine English language translation of JP 2002236379, Aug. 23, 2002.*
(Continued)

*Primary Examiner* — Hoa V Le
(74) *Attorney, Agent, or Firm* — Fitzpatrick, Cella, Harper & Scinto

(57) ABSTRACT

A surface layer of the electrophotographic photosensitive member has a change region in which a ratio of the number of carbon atoms with respect to the sum of the number of silicon atoms and the number of carbon atoms gradually increases toward a surface side of the electrophotographic photosensitive member from a photoconductive layer side, wherein the change region has an upper charge injection prohibiting portion containing a Group 13 atom, and a surface-side portion which is positioned closer to the surface side of the electrophotographic photosensitive member than the upper charge injection prohibiting portion and does not contain the Group 13 atom, and the distribution of the Group 13 atom in a boundary portion between the surface-side portion and the upper charge injection prohibiting portion is precipitous.

12 Claims, 9 Drawing Sheets

(51) Int. Cl.
*G03G 5/147* (2006.01)
*G03G 5/05* (2006.01)

(52) U.S. Cl.
CPC ..... *G03G 5/08221* (2013.01); *G03G 5/08235* (2013.01); *G03G 5/14704* (2013.01)

(56) References Cited

U.S. PATENT DOCUMENTS

| | | | |
|---|---|---|---|
| 4,683,145 | A | 7/1987 | Nishimura et al. |
| 4,683,146 | A | 7/1987 | Hirai et al. |
| 4,683,147 | A | 7/1987 | Eguchi et al. |
| 5,582,944 | A | 12/1996 | Yamamura et al. |
| 5,656,404 | A | 8/1997 | Niino et al. |
| 8,168,365 | B2 | 5/2012 | Ozawa et al. |
| 8,173,344 | B2 | 5/2012 | Akiyama et al. |
| 8,323,862 | B2 | 12/2012 | Ozawa et al. |
| 8,445,168 | B2 | 5/2013 | Akiyama et al. |
| 8,465,891 | B2 | 6/2013 | Ozawa et al. |
| 8,563,203 | B2 | 10/2013 | Nishimura et al. |
| 8,630,558 | B2 | 1/2014 | Nishimura et al. |
| 8,685,611 | B2 | 4/2014 | Ozawa et al. |
| 2011/0280594 | A1 | 11/2011 | Tanaka |
| 2011/0299886 | A1 | 12/2011 | Hosoi et al. |

FOREIGN PATENT DOCUMENTS

| | | | | |
|---|---|---|---|---|
| JP | 09-015963 | A | 1/1997 | |
| JP | 3088840 | B2 | 7/2000 | |
| JP | 3262478 | B2 | 12/2001 | |
| JP | 2002236379 | * | 8/2002 | ..... G03G 5/08 |
| JP | 2008-020534 | A | 1/2008 | |
| JP | 2012-003246 | A | 1/2012 | |

OTHER PUBLICATIONS

European Search Report dated Jun. 26, 2014, in related European Patent Application No. 14155866.8.

* cited by examiner

ELECTROPHOTOGRAPHIC PHOTOSENSITIVE MEMBER, METHOD FOR MANUFACTURING THE SAME, AND ELECTROPHOTOGRAPHIC APPARATUS

BACKGROUND OF THE INVENTION

1. Field of the Invention

The present invention relates to an electrophotographic photosensitive member, a method for manufacturing the same, and an electrophotographic apparatus having the electrophotographic photosensitive member.

2. Description of the Related Art

As one type of an electrophotographic photosensitive member (hereinafter referred to simply as "photosensitive member" as well) to be used in an electrophotographic apparatus, a photosensitive member is known which employs hydrogenated amorphous silicon as a photoconductive material (hereinafter referred to as "a-Si photosensitive member" as well).

The a-Si photosensitive member is manufactured by forming a photoconductive layer which is formed from the hydrogenated amorphous silicon on a conductive substrate (hereinafter referred to simply as "substrate" as well), generally, with a film-forming method such as a plasma CVD method.

Conventionally, it has been investigated to improve various characteristics such as electrical properties, optical properties, photoconductive properties, characteristics in a use environment, and the stability with time of the a-Si photosensitive member. As one of technologies for improving the characteristics of the a-Si photosensitive member, a technology is known which provides a surface layer formed from hydrogenated amorphous silicon carbide (hereinafter referred to as "a-SiC" as well) on a photoconductive layer that is formed from hydrogenated amorphous silicon (hereinafter referred to as "a-Si" as well).

In Japanese Patent Application Laid-Open No. 2002-236379, it is described to provide a region in which a ratio (C/(Si+C)) of the number of carbon atoms (C) with respect to the sum of the number of silicon atoms (Si) and the number of carbon atoms (C) gradually increases toward the surface side of the photosensitive member from the photoconductive layer side, (in the present invention, hereinafter referred to as "change region" as well), in the surface layer formed from the a-SiC, and to make this change region contain an atom which belongs to Group 13 of the Periodic Table (hereinafter referred to as "Group 13 atom" as well).

In recent years, the digitization and the full colorization of an electrophotographic apparatus are progressing, and the image quality of an output image becomes higher.

In the digitized and the full-colorizing electrophotographic apparatus, in order to enhance the image quality of the output image, negative electrification is adopted for electrifying the photosensitive member, an image area exposure method (IAE) is adopted for forming an electrostatic latent image, and a negative toner is adopted as a color toner, in many cases.

Accordingly, the photosensitive member to be negatively electrified is required to have a function of blocking an electric charge (electron) from being injected into the photoconductive layer from the surface of the photosensitive member as much as possible, in order to have the charging ability when the photosensitive member is negatively electrified.

Conventionally, it has been attempted in the a-Si photosensitive member to be negatively electrified to enhance the charging ability shown when the photosensitive member is negatively electrified, by providing a portion containing the Group 13 atom in the surface layer as a portion for blocking the electric charge from being injected into the photoconductive layer from the surface of the photosensitive member, as is described in Japanese Patent Application Laid-Open No. 2002-236379.

However, in recent years, the case has increased where a large amount of digitized information is output, and the requirement of outputting an image at high speed has accordingly increased. In order to output the image at high speed, it becomes necessary to further enhance the charging ability and the luminous sensitivity of the photosensitive member.

An object of the present invention is to provide an electrophotographic photosensitive member which is excellent in charging ability when the photosensitive member is negatively electrified and in luminous sensitivity, a method for manufacturing the same, and an electrophotographic apparatus having the electrophotographic photosensitive member.

SUMMARY OF THE INVENTION

When the photosensitive member is installed on the electrophotographic apparatus and an output of a charging device (primary charging device) in the electrophotographic apparatus is increased, the amount of an electric charge held on the surface of the photosensitive member increases in response to the increase, and the surface potential of the photosensitive member becomes high.

When the image is output at high speed as has been described above, the moving speed (rotational speed of photosensitive member) of the surface of the photosensitive member results in increasing, and as a result, a period of time decreases for which the surface of the photosensitive member passes through a position facing the charging device, and accordingly the amount of the electric charge to be supplied to the surface of the photosensitive member from the charging device tends to decrease. Because of this, it becomes difficult for the photosensitive member to obtain a predetermined surface potential.

In addition, when the amount of the electric charge to be supplied to the surface of the photosensitive member from the charging device is comparatively small, the surface potential of the photosensitive member forms a linear relationship with the amount of the electric charge to be supplied to the surface of the photosensitive member from the charging device. However, when the amount of the electric charge to be supplied to the surface of the photosensitive member from the charging device increases, this linear relationship deteriorates, and it becomes difficult for the photosensitive member to obtain a predetermined surface potential. Because of this, in order that the photosensitive member obtains the predetermined surface potential, the charging device needs to further increase the amount of the electric charge to be supplied to the surface of the photosensitive member.

The present inventors have investigated the reason why the above-described linear relationship deteriorates, and as a result, have found that the reason exists in the way of making the change region in the surface layer contain a Group 13 atom.

The portion which contains the Group 13 atom in the change region in the surface layer (hereinafter referred to as "upper charge injection prohibiting portion" as well) is a portion which has a function of blocking a negative electric charge from being injected into the photoconductive layer from the surface of the photosensitive member, when the surface of the photosensitive member has been negatively electrified. Because of having such a function, this upper charge injection prohibiting portion employs a-SiC which constitutes the change region, as a base material, and contains the Group 13 atom as an atom for controlling an electrical conduction property. Thereby, the upper charge injection prohibiting portion results in having a P-type electrical conduction property, and accordingly can block the negative electric charge from being injected into the photoconductive layer from the surface of photosensitive member.

On the other hand, if a portion closer to the surface side of the photosensitive member than the upper charge injection prohibiting portion (hereinafter referred to as "surface-side portion" as well) in the change region is not made to contain the atom for controlling the electrical conduction property such as the Group 13 atom, the surface-side portion results in showing an I-type electrical conduction property or a slightly N-type electrical conduction property.

The surface-side portion comes in contact with the upper charge injection prohibiting portion in the change region, and accordingly an equilibrium state is formed in such a state that Fermi levels in both portions coincide with each other. As a result, in a boundary portion between the surface-side portion and the upper charge injection prohibiting portion, the energy level of the conduction band in the upper charge injection prohibiting portion becomes sharply high with respect to the energy level of the conduction band in the surface-side portion. In other words, a high energy barrier is formed in the boundary portion between the surface-side portion and the upper charge injection prohibiting portion.

When a negative electric charge is injected toward the photoconductive layer from the surface of the photosensitive member in such a state, the injection of the negative electric charge into the upper charge injection prohibiting portion from the surface-side portion in the change region is suppressed by the above-described energy barrier in the boundary portion.

When the change region in the surface layer is formed by a plasma CVD method, for instance, the upper charge injection prohibiting portion in the change region is formed by introducing a source gas for supplying the Group 13 atom together with a source gas for introducing a silicon atom and a source gas for introducing a carbon atom, into a reaction vessel.

Conventionally, in the process of forming the change region in the surface layer, the source gas for introducing the silicon atom and the source gas for introducing the carbon atom are introduced into a reaction vessel, and after a predetermined period of time has passed, the source gas for supplying the Group 13 atom is additionally introduced into the reaction vessel while the flow rate of the source gas is gradually increased to a predetermined flow rate. Then, after a predetermined period of time has passed and the portion containing the Group 13 atom (upper charge injection prohibiting portion) has been formed, the amount of the source gas for supplying the Group 13 atom which is introduced into the reaction vessel is gradually decreased, and finally the introduction of the source gas for supplying the Group 13 atom into the reaction vessel is completed. The upper charge injection prohibiting portion formed in this way also has a P-type electrical conduction property, and accordingly has the function of blocking the negative electric charge from being injected into the photoconductive layer from the surface of the photosensitive member.

However, in the conventional boundary portion between the surface-side portion and the upper charge injection prohibiting portion in the change region, the amount of the source gas for supplying the Group 13 atom which is introduced into the reaction vessel is gradually decreased, and accordingly the content of the Group 13 atom gradually decreases toward the surface-side portion side from the upper charge injection prohibiting portion side. For this reason, in the conventional boundary portion between the surface-side portion and the upper charge injection prohibiting portion in the change region, the electrical conduction property is gradually changed to the I-type electrical conduction property or the slight N-type electrical conduction property from the P-type electrical conduction property. As a result, in the conventional boundary portion between the surface-side portion and the upper charge injection prohibiting portion in the change region, the energy level has resulted in gradually changing to the energy level of the conduction band in the upper charge injection prohibiting portion from the energy level of the conduction band in the surface-side portion. In other words, it is considered that a sufficient energy barrier has not been formed in the conventional boundary portion between the surface-side portion and the upper charge injection prohibiting portion in the change region.

When a negative electric charge is injected toward the photoconductive layer from the surface of the photosensitive member in such a state, it becomes difficult to suppress the injection of the negative electric charge into the upper charge injection prohibiting portion from the surface-side portion in the change region, because the above-described energy barrier of the boundary portion is not high. When the amount of the negative electric charge is increased which is supplied to the surface of the photosensitive member from the charging device, in particular, the amount of the negative electric charge remarkably increases which is injected into the upper charge injection prohibiting portion from the surface-side portion in the change region, due to band bending.

Because of this, it is considered that when the amount of the electric charge (negative electric charge) increases which is supplied to the surface of the photosensitive member from the charging device, the above-described linear relationship deteriorates.

From the above description, it is considered that it is greatly significant to control the distribution of the Group 13 atom in the boundary portion between the surface-side portion and the upper charge injection prohibiting portion in the change region in the surface layer of the a-Si photosensitive member, for obtaining an a-Si photosensitive member which is excellent in charging ability when the photosensitive member is negatively electrified. Specifically, it is considered that it is greatly significant to control the distribution of the Group 13 atom so that the Group 13 atom sharply increases toward the upper charge injection prohibiting portion side from the surface-side portion side in the boundary portion, for obtaining the a-Si photosensitive member which is excellent in the charging ability when the photosensitive member is negatively electrified.

There are various types of methods for analysis of the distribution of the atoms in a layer (deposition film).

Among the various types of the analysis methods, a secondary ion mass spectrometry (hereinafter referred to as "SIMS" as well) is frequently used, from the viewpoint of being capable of analyzing the concentration of the atoms in a depth direction (thickness direction of layer) in the layer (deposition film), and having a resolving power of a ppm order.

Conventionally, there have been many studies on evaluations of the distribution of the atoms in the boundary portion (boundary) between the layers (deposition films) and of the precipitous property, by the SIMS.

For instance, in "Quantitative depth profiling in surface analysis: Areview" by S. Hofmann, SURFACE AND INTERFACE ANALYSIS, Vol. 2 No. 4, p. 148 (1980), a value is shown which is obtained by normalizing a standard deviation by the thickness of a layer, with respect to the thickness of the layer.

In addition, in "SIMS Analysis of Compound Semiconductor Superlattice Heterojunction Interface" by Yoshiaki Yoshioka and Kazuyoshi Tsukamoto, Journal of the Mass Spectrometry Society of Japan, Vol. 34, No. 2, pp. 89 to 97 (1986), a standard deviation is shown which becomes an index of the precipitous property of the distribution of the atoms in the boundary portion (boundary) between the layers, with respect to the thickness of the layer and the primary ion energy.

However, the precipitous property of the distribution (resolution in depth direction (thickness direction) of boundary portion) of the atoms in the boundary portion (boundary) between the layer and the layer, which is obtained from the analysis with the SIMS (hereinafter referred to also as "SIMS analysis" as well), is easy to vary depending on measurement conditions. As a result, even though the boundary portion (boundary) between the layer and the layer actually exists, in which the distribution of the atoms is precipitous, it occasionally appears that the distribution of the atoms gradually (not precipitously) changes with respect to the depth direction (thickness direction) of the boundary portion (boundary), when a profile in the depth direction (thickness direction) of the distribution of the atoms (hereinafter referred to as "depth profile" as well) is viewed, which is obtained by the SIMS analysis.

Because of this, various studies are carried out under present circumstances on an analysis apparatus, an analysis method, a method for producing a standard sample and an analyzing method, in order to accurately measure the distribution of the atoms in the boundary portion (boundary) between the layer and the layer with the SIMS analysis and evaluate the precipitous property.

As has been described above, the distribution of the Group 13 atom in the boundary portion between the surface-side portion and the upper charge injection prohibiting portion in the change region in the surface layer of the a-Si photosensitive member becomes an important factor to decide the charging ability of the a-Si photosensitive member to be negatively electrified. However, conventionally, it has been difficult to accurately evaluate the distribution of the Group 13 atom and the precipitous property in the boundary portion between the surface-side portion and the upper charge injection prohibiting portion in the above-described change region, for the a-Si photosensitive members which have various compositions.

As has been described above, the result of the SIMS analysis results in varying depending on the measurement conditions. However, when the measurement conditions are fixed, the reproducibility of the result of the SIMS analysis is excellent.

Then, the present inventors have considered that the precipitous property of the distribution of the Group 13 atom in the boundary portion can be accurately evaluated, by analyzing the distribution of the Group 13 atom in the boundary portion between the surface-side portion and the upper charge injection prohibiting portion in the above-described change region, in the following way.

Specifically, firstly, a laminated film (hereinafter referred to as "standard laminated film A" as well) is produced, which has a film (hereinafter referred to as "film $A_1$" as well) that has a composition corresponding to the upper charge injection prohibiting portion in the above-described change region, and a film (hereinafter referred to as "film $A_2$" as well) that has a composition corresponding to the surface-side portion in the above-described change region, stacked in this order. When the standard laminated film A is produced, theoretically, the production method should be minded so that the distribution of the Group 13 atom becomes precipitous in the boundary portion (boundary) between the film $A_2$ containing no Group 13 atom and the film $A_1$ containing the Group 13 atom. Then, the distribution of the Group 13 atom in the boundary portion (boundary) between the film $A_2$ and the film $A_1$ is measured for this standard laminated film A, by the SIMS analysis on predetermined measurement conditions, while the surface of the film $A_2$ is set to be the surface of the standard laminated film A.

Next, the distribution of the Group 13 atom in the boundary portion between the surface-side portion and the upper charge injection prohibiting portion in the change region in the surface layer is measured by the SIMS analysis on the same measurement conditions as the above-described predetermined measurement conditions, while the surface of the surface layer of the a-Si photosensitive member to be evaluated is set to be the surface of the a-Si photosensitive member. Then, the measurement result of the a-Si photosensitive member which is an object to be evaluated (where precipitous property of distribution of the Group 13 atom in the boundary portion between surface-side portion and upper charge injection prohibiting portion is expressed by $\Delta Z$) is relatively compared (value of $\Delta Z/\Delta Z_0$ is confirmed) with the reference to the measurement result in the standard laminated film A (where precipitous property of distribution of the Group 13 atom in the boundary portion (boundary) between the film $A_2$ and the film $A_1$ is expressed by $\Delta Z_0$), and thereby the distribution of the Group 13 atom in the boundary portion between the surface-side portion and the upper charge injection prohibiting portion in the change region in the surface layer of the a-Si photosensitive member can be evaluated.

Thus, the present inventors have found out that it produces a large effect on obtaining the a-Si photosensitive member having excellent charging ability when the photosensitive member is negatively electrified to evaluate the precipitous property of the distribution of the Group 13 atom in the boundary portion between the surface-side portion and the upper charge injection prohibiting portion in the change region in the surface layer of the a-Si photosensitive member with a value of $\Delta Z/\Delta Z_0$, and to control this value to a specific range (to control this value so that Group 13 atom sharply increases to some extent or more toward the side of the upper charge injection prohibiting portion from the side of the surface-side portion in the boundary portion); and have accomplished the present invention.

Specifically, the present invention provides an electrophotographic photosensitive member to be negatively electrified that includes: a conductive substrate; a photoconductive layer which is formed from hydrogenated amorphous silicon on the conductive substrate; and a surface layer which is formed from hydrogenated amorphous silicon carbide on the photoconductive layer, wherein the surface layer has a change region in which a ratio (C/(Si+C)) of a number of carbon atoms (C) with respect to a sum of a number of silicon atoms (Si) and the number (C) of carbon atoms gradually increases toward a surface side of the electrophotographic photosensitive member from the photoconductive layer side, the change region has an upper charge injection prohibiting portion containing a Group 13 atom, and a surface-side portion which is positioned closer to a surface side of the electrophotographic photosensitive member than the upper charge injection prohibiting portion and does not contain the Group 13 atom, and when a precipitous property of the distribution of the Group 13 atom in a boundary portion between the surface-side portion and the upper charge injection prohibiting portion is evaluated by a following evaluation method A, the precipitous property satisfies a relation expressed by a following expression (A7).

Evaluation method A of precipitous property of distribution of Group 13 atom (A1) A depth profile of the surface of the electrophotographic photosensitive member is obtained by an SIMS analysis.

(A2) In the depth profile, a distance from the surface of the electrophotographic photosensitive member shall be represented by D, an ionic strength of the Group 13 atom at the distance D shall be represented by a function f(D) of the distance D, a maximal value of f(D) shall be represented by $f(D_{MAX})$, a second order differential of f(D) shall be represented by f''(D), a distance of a point at which when D is increased toward the photoconductive layer, f''(D) changes from f''(D)=0 to f''(D)<0, from the surface of the electrophotographic photosensitive member, shall be represented by $D_A$, and a distance of a point at which f''(D) subsequently changes from f''(D)<0 to f''(D)=0, from the surface of the electrophotographic photosensitive member, shall be represented by $D_B$.

(A3) Among the distances D which satisfy $f((D_A+D_B)/2) \geq f(D_{MAX})\times 0.5$, a first distance when the upper charge injection prohibiting portion is viewed from the surface of the electrophotographic photosensitive member shall be represented by $D_S$, and the ionic strength f(D) of the Group 13 atom at the distance $D_S$ shall be represented by a standard ionic strength $f(D_S)$.

(A4) A length in a thickness direction of the boundary portion shall be represented by a precipitous property ΔZ, in which the ionic strength of the Group 13 atom in the boundary portion between the surface-side portion and the upper charge injection prohibiting portion increases from 16% to 84%, when viewed from the surface of the electrophotographic photosensitive member and when the standard ionic strength $f(D_S)$ is determined to be 100%.

(A5) A standard laminated film A is produced which has a film $A_1$ that has a composition corresponding to the upper charge injection prohibiting portion and a film $A_2$ that has a composition corresponding to the surface-side portion, stacked in this order.

(A6) The surface of the film $A_2$ is determined to be a surface of the standard laminated film A with respect to the standard laminated film A, and a precipitous property $\Delta Z_0$ in the boundary portion between the film $A_2$ and the film $A_1$ of the standard laminated film A is determined by similar steps to the steps (A1) to (A4).

(A7)

$$1.0 \leq \Delta Z/\Delta Z_0 \leq 3.0 \quad \text{(A7)}$$

The present invention can provide an electrophotographic photosensitive member which is excellent in charging ability and luminous sensitivity when the photosensitive member is negatively electrified, a method for manufacturing the same, and an electrophotographic apparatus having the electrophotographic photosensitive member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An electrophotographic photosensitive member according to the present invention is an electrophotographic photosensitive member to be negatively electrified that includes: a conductive substrate; a photoconductive layer which is formed from hydrogenated amorphous silicon on the conductive substrate; and a surface layer which is formed from hydrogenated amorphous silicon carbide on the photoconductive layer.

Figure 1A:
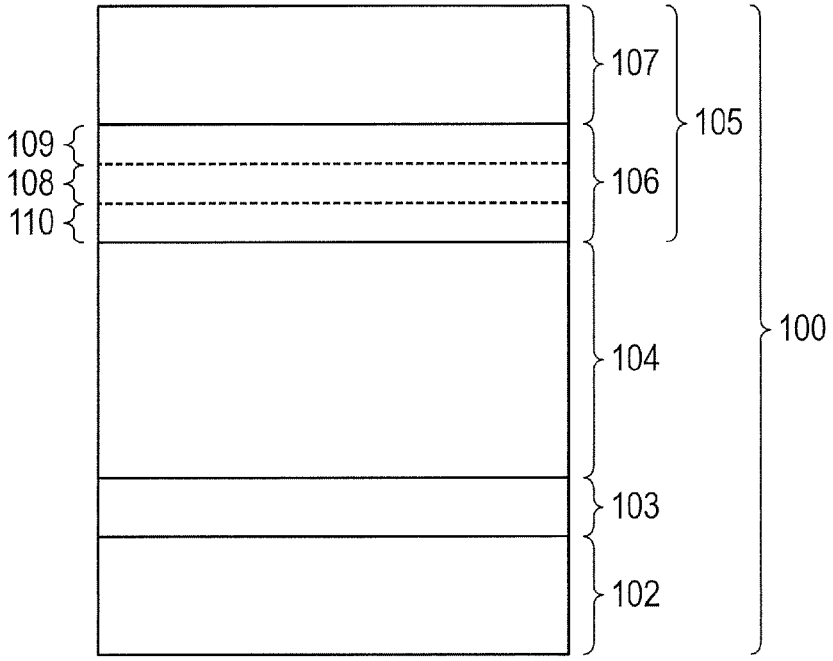
FIG. 1A and FIG. 1B are views illustrating an example of a layer structure of an electrophotographic photosensitive member to be negatively electrified according to the present invention.
Figure 1B:
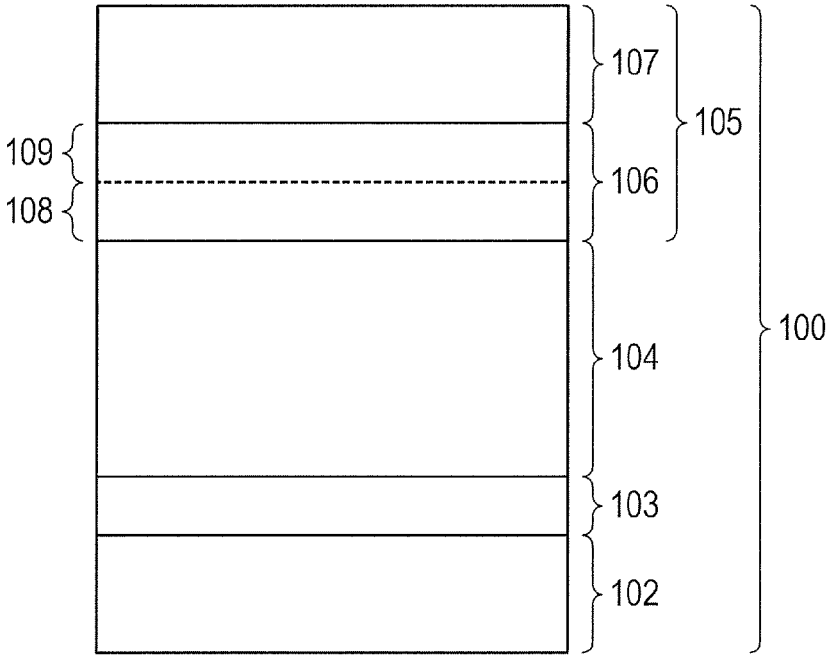

FIG. 1A and FIG. 1B are views illustrating an example of a layer structure of the electrophotographic photosensitive member (a-Si photosensitive member) to be negatively electrified according to the present invention.

The electrophotographic photosensitive member (photosensitive member) 100 illustrated in FIGS. 1A and 1B is an a-Si photosensitive member which has a lower charge injection prohibiting layer 103, a photoconductive layer 104 and a surface layer 105, formed on a conductive substrate (substrate) 102 in this order.

The photoconductive layer 104 is a layer which is formed from hydrogenated amorphous silicon (a-Si), and the surface layer 105 is a layer which is formed from hydrogenated amorphous silicon carbide (a-SiC).

A change region 106 is provided in the surface layer 105 of the photosensitive member 100. The change region 106 which is provided in the surface layer 105 formed from the a-SiC is also formed from the a-SiC.

In the present invention, the change region 106 indicates a region in which a ratio (C/(Si+C)) of the number of carbon atoms (C) with respect to the sum of the number of silicon atoms (Si) and the number of carbon atoms (C) gradually increases toward the surface side of the photosensitive member 100 from the photoconductive layer 104 side. A region (surface-side region) 107 in FIGS. 1A and 1B is positioned closer to the surface side of the photosensitive member than the change region 106 in the surface layer 105. In other words, the change region 106 and the surface-side region 107 are provided in the surface layer 105 of the photosensitive member 100 illustrated in FIGS. 1A and 1B. The surface-side region 107 which is provided in the surface layer 105 formed from the a-SiC is also formed from the a-SiC.

In the electrophotographic photosensitive member (photosensitive member) 100 illustrated in FIG. 1A, the change region 106 in the surface layer 105 has an upper charge injection prohibiting portion 108, a surface-side portion 109 which is positioned closer to the surface side of the photosensitive member 100 than the upper charge injection prohibiting portion 108, and a photoconductive layer-side portion 110 which is positioned closer to the photoconductive layer 104 side than the upper charge injection prohibiting portion 108, provided therein.

In the electrophotographic photosensitive member (photosensitive member) 100 illustrated in FIG. 1B, the change region 106 in the surface layer 105 has the upper charge injection prohibiting portion 108, and the surface-side portion 109 which is positioned closer to the surface side of the photosensitive member 100 than the upper charge injection prohibiting portion 108, provided therein.

In the present invention, the upper charge injection prohibiting portion 108 is a portion which employs the a-SiC that constitutes the change region 106, as a base material, and further contains a Group 13 atom as an atom for controlling its electrical conduction property. The surface-side portion 109 and the photoconductive layer-side portion 110 are portions which are formed from the a-SiC and do not contain the Group 13 atom.

In the photosensitive member 100 illustrated in FIG. 1A, the upper charge injection prohibiting portion 108 is provided almost in the middle of the change region 106 in the surface layer 105.

In the photosensitive member 100 illustrated in FIG. 1B, the upper charge injection prohibiting portion 108 is provided closest to the photoconductive layer 104 side in the change region 106 in the surface layer 105, and the upper charge injection prohibiting portion 108 comes in contact with the photoconductive layer 104.

(Substrate 102)

The substrate 102 has each layer of the photoconductive layer 104, the surface layer 105 and the like formed thereon, and supports the layers. When the surface of the photosensitive member 100 is negatively electrified, an electron out of photocarriers which have been generated in the photoconductive layer 104 moves to the substrate 102 side, and a positive hole moves to the surface of the photosensitive member 100.

The substrate 102 used in the present invention is a substrate having electrical conductivity (conductive substrate).

Metal such as copper, aluminum, nickel, cobalt, iron, chromium, molybdenum and titanium, and an alloy material thereof, for instance, can be used as a material for the conductive substrate. Among the metals and the alloys, aluminum (aluminum alloy) can be used from the viewpoint of workability and a manufacturing cost. The aluminum alloy includes, for instance, an Al—Mg-based alloy and an Al—Mn-based alloy.

In addition, a substrate can also be used which is formed from a resin such as polyester, polyamide or the like, and at least a surface to have a layer (deposition film) formed thereon is electroconductive-treated.

In addition, the thickness of the substrate 102 can be 10 μm or more, from the viewpoint of being easily handled, mechanical strength and the like.

(Lower Charge Injection Prohibiting Layer 103)

In the present invention, a lower charge injection prohibiting layer 103 can be provided between the substrate 102 and the photoconductive layer 104 so as to block an electric charge (positive hole) from being injected into the photoconductive layer 104 from the substrate 102 side when the surface of the photosensitive member 100 has been negatively electrified.

The lower charge injection prohibiting layer 103 can be formed from a-Si. In addition, the lower charge injection prohibiting layer 103 is made to further contain at least one type of atom out of a carbon atom, a nitrogen atom and an oxygen atom in the a-Si which is used as a base material, thereby being able to enhance the capability of blocking the electric charge (positive hole) from being injected into the photoconductive layer 104 from the substrate 102, and enhance adhesiveness between the substrate 102 and the lower charge injection prohibiting layer 103.

At least one type of atom out of the carbon atom (C), the nitrogen atom (N) and the oxygen atom (0) to be contained in the lower charge injection prohibiting layer 103 may be contained in a state of being uniformly distributed in the lower charge injection prohibiting layer 103. In addition, it is also acceptable that though atoms are uniformly contained in the layer thickness direction, there is a part in which atoms are contained in a nonuniformly distributed state. In any case, at least one type of atom out of the carbon atom, the nitrogen atom and the oxygen atom can be contained in the lower charge injection prohibiting layer 103 in the state of being uniformly distributed in a direction of a plane parallel to the surface of the substrate 102, from the viewpoint of uniformizing the electrophotographic characteristics.

In addition, in the present invention, it is also acceptable to make the lower charge injection prohibiting layer 103 contain an atom for controlling an electrical conduction property, as needed.

The atom to be contained in the lower charge injection prohibiting layer 103 for controlling the electrical conduction property may be contained in the state of being uniformly distributed in the lower charge injection prohibiting layer 103. In addition, atoms may also be contained in a nonuniformly distributed state in the thickness direction of the lower charge injection prohibiting layer 103. When the distribution of the atoms for controlling the electrical conduction property is uniform in the lower charge injection prohibiting layer 103, atoms can be contained in the state of being distributed more in the substrate 102 side. In any case, the atoms for controlling the electrical conduction property can be contained in the lower charge injection prohibiting layer 103 in the state of being uniformly distributed in a direction of the plane parallel to the surface of the substrate 102, from the viewpoint of uniformizing the electrophotographic characteristics.

An atom which belongs to Group 15 of the Periodic Table (hereinafter referred to as "Group 15 atom" as well) can be used as the atom which is contained in the lower charge injection prohibiting layer 103 for controlling the electrical conduction property, and the Group 15 atom includes, for instance, a nitrogen atom (N), a phosphorus atom (P), an arsenic atom (As), an antimony atom (Sb) and a bismuth atom (Bi).

The thickness of the lower charge injection prohibiting layer 103 can be 0.1 to 10 μm, further be 0.3 to 5 μm, and still further be 0.5 to 3 μm, from the viewpoint of the electrophotographic characteristics, the economical efficiency and the like. As the thickness of the lower charge injection prohibiting layer 103 increases, the capability of blocking the electric charge (positive hole) from being injected into the photoconductive layer 104 from the substrate 102 is enhanced. In addition, as the thickness of the lower charge injection prohibiting layer 103 decreases, the lower charge injection prohibiting layer 103 can be formed in a shorter period of time.

(Photoconductive Layer 104)

The photoconductive layer 104 which is formed from a-Si is a layer in which a photocarrier is generated due to photoconductivity, when image-exposing light or pre-exposure light has been incident.

The a-Si which constitutes the photoconductive layer 104 is an amorphous material that uses a hydrogen atom as an atom for compensating an uncombined hand of the silicon atom, which is an atom for forming the skeleton, but a halogen atom may also be used in combination as the atom for compensating the uncombined hand of the silicon atom.

A ratio ((H+X)/(Si+H+X)) of the number of the hydrogen atom (H) and the number of the halogen atom (X) with respect to the sum of the number of the silicon atom (Si), the number of the hydrogen atom (H) and the number of the halogen atom (X) in the photoconductive layer 104 can be 0.10 or more, and further be 0.15 or more. On the other hand, the ratio can be 0.30 or less, and further be 0.25 or less.

In addition, in the present invention, it is also acceptable to make the photoconductive layer 104 contain an atom for controlling an electrical conduction property, as needed.

Atoms which are contained in the photoconductive layer 104 for controlling the electrical conduction property may be contained in the state of being uniformly distributed in the photoconductive layer 104. In addition, atoms may also be contained in a nonuniformly distributed state in the thickness direction of the photoconductive layer 104. In any case, atoms for controlling the electrical conduction property can be contained in the photoconductive layer 104 in the state of being uniformly distributed in a direction of the plane parallel to the surface of the substrate 102, from the viewpoint of uniformizing the electrophotographic characteristics.

A Group 13 atom which gives the P-type electrical conduction property to the photoconductive layer 104 or a Group 15 atom which gives the N-type electrical conduction property to the photoconductive layer 104 can be used as the atom which is contained in the photoconductive layer 104 for controlling the electrical conduction property.

The Group 13 atoms include, for instance, a boron atom (B), an aluminum atom (Al), a gallium atom (Ga), an indium atom (In) and a thallium atom (Tl). Among the atoms, the boron atom, the aluminum atom and the gallium atom can be used.

The Group 15 atoms specifically include a phosphorus atom (P), an arsenic atom (As), an antimony atom (Sb) and a bismuth atom (Bi). Among the atoms, the phosphorus atom and the arsenic atom can be used.

The content of the atom which is contained in the photoconductive layer 104 for controlling the electrical conduction property can be $1\times10^{-2}$ atomic ppm or more with respect to the silicon atom, further be $5\times10^{-2}$ atomic ppm or more, and still further be $1\times10^{-1}$ atomic ppm or more. On the other hand, the content can be $1\times10^{4}$ atomic ppm or less, further be $5\times10^{3}$ atomic ppm or less, and still further be $1\times10^{3}$ atomic ppm or less.

In the present invention, the thickness of the photoconductive layer 104 can be 15 μm or more, and further be 20 μm or more, from the viewpoint of the electrophotographic characteristics, the economical efficiency and the like. On the other hand, the thickness can be 60 μm or less, further be 50 μm or less, and still further be 40 μm or less. As the thickness of the photoconductive layer 104 decreases, the amount of the electric current passing through a charging member is reduced, and the deterioration is suppressed. In addition, when the thickness of the photoconductive layer 104 is intended to increase, an abnormal growth site of the a-Si is easy to become large (specifically, up to the size of 50 to 150 μm in horizontal direction and 5 to 20 μm in height direction).

In addition, the photoconductive layer 104 may be formed of a single layer, or may be formed of a plurality of layers (for instance, charge-generating layer and charge-transporting layer)

(Surface-Side Region 107 in Surface Layer 105)

In the present invention, the surface-side region 107 can further be provided in the surface layer 105, which is positioned closer to the surface side of the photosensitive member 100 than the change region 106, for imparting the electrical properties, the optical properties, the photoconductive properties, the characteristics in the use environment, the stability with time and the like.

Carbon atoms which are contained in the surface-side region 107 may be contained in the state of being uniformly distributed in the surface-side region 107, or may be contained in a nonuniformly distributed state in the thickness direction of the surface-side region 107. When carbon atoms are nonuniformly distributed in the thickness direction of the surface-side region 107, the carbon atoms can be distributed so that the carbon atoms become less in the substrate 102 side. In both cases where carbon atoms are uniformly distributed in the surface-side region 107 and where carbon atoms are nonuniformly distributed in the thickness direction of the surface-side region 107, the carbon atoms can be distributed uniformly in a direction parallel to the surface of the substrate 102, from the viewpoint of uniformizing the characteristics.

In the surface-side region 107, the ratio (C/(Si+C)) of the number of the carbon atoms (C) with respect to the sum of the number of the silicon atoms (Si) and the number of the carbon atoms (C) can be in a range of more than 0.50 and 0.98 or less, from the viewpoint of the electrical properties, the optical properties, the photoconductive properties, the characteristics in the use environment and the stability with time of the a-Si photosensitive member.

The surface-side region 107 is formed from a-SiC, as has been described above. The a-SiC is an amorphous material that uses a hydrogen atom as an atom for compensating uncombined hands of the silicon atom and the carbon atom, which are atoms for forming the skeleton, but a halogen atom may also be used in combination as the atom for compensating the uncombined hands of the silicon atom and the carbon atom.

The content of the hydrogen atom in the a-SiC which constitutes the surface-side region 107 can be 30 to 70 atom % with respect to the total amount of the atoms that constitute the a-SiC, further be 35 to 65 atom %, and still further be 40 to 60 atom %. In addition, when the halogen atom is used in combination as the atom for compensating the uncombined hands of the silicon atom and the carbon atom, the content of the halogen atom in the a-SiC which constitutes the surface-side region 107 can be 0.01 to 15 atom % with respect to the total amount of the atoms that constitute the a-SiC, further be 0.1 to 10 atom %, and still further be 0.6 to 4 atom %.

The thickness of the surface-side region 107 in the surface layer 105 can be 0.1 to 4 μm, further be 0.15 to 3 μm, and still further be 0.2 to 2 μm, from the viewpoint of the electrophotographic characteristics, the economical efficiency and the like. As the thickness of the surface-side region 107 increases, the surface layer 105 or the surface-side region 107 in the surface layer 105 resists being lost, even when the surface of the photosensitive member 100 is worn during use. In addition, as the thickness of the surface-side region 107 decreases, a residual potential resists being increased.

(Change Region 106 in Surface Layer 105)

The change region 106 is formed from a-SiC, as has been described above. The a-SiC is an amorphous material that uses a hydrogen atom as an atom for compensating uncombined hands of the silicon atom and the carbon atom, which are atoms for forming the skeleton, but a halogen atom may also be used in combination as the atom for compensating the uncombined hands of the silicon atom and the carbon atom. The suitable ranges of the content of the hydrogen atom and the content of the halogen atom in the a-SiC are similar to those in the case of the above-described surface-side region 107.

In addition, in the change region 106, a ratio (C/(Si+C)) of the number of the carbon atoms (C) with respect to the sum of the number of the silicon atoms (Si) and the number of the carbon atoms (C) gradually increases toward the surface side of the photosensitive member 100 from the photoconductive layer 104 side.

In the change region 106, the above-described ratio (C/(Si+C)) is controlled to be smaller in the photoconductive layer 104 side than in the surface side of the photosensitive member 100, in order to eliminate or make a difference as small as possible between the refractive index of a site in the change region 106 side of the photoconductive layer 104 which is formed from a-Si and the refractive index of a site in the photoconductive layer 104 side of the change region 106. When the photoconductive layer 104 comes in contact with the change region 106 in the surface layer 105, by eliminating or making the above-described difference between the two refractive indices as small as possible, the boundary portion (boundary) between the photoconductive layer 104 and the surface layer 105 (change region 106 in surface layer 105) can reduce the amount of the reflection light there.

The refractive index of the a-SiC has a correlation with the ratio (C/(Si+C)) of the number of the carbon atoms (C) to the sum of the number of the silicon atoms (Si) and the number of the carbon atoms (C) in the change region 106, and the above-described ratio (C/(Si+C)) increases, the refractive index of the a-SiC shows a tendency to decrease. In addition, the refractive index of the a-SiC is generally smaller than the refractive index of the a-Si. Accordingly, as the above-described ratio (C/(Si+C)) of the a-SiC decreases, the refractive index approaches the refractive index of the a-Si. Therefore, the minimum value of the above-described ratio (C/(Si+C)) in the change region 106 can be in a range of 0.0 or more and 0.1 or less.

On the other hand, in the change region 106, the above-described ratio (C/(Si+C)) is controlled to be larger in the surface side of the photosensitive member 100 than in the photoconductive layer 104 side, in order to eliminate or make a difference as small as possible between the refractive index of a site in the surface-side region 107 side of the change region 106 and the refractive index of a site in the change region 106 side of the surface-side region 107, when the above-described ratio (C/(Si+C)) of the surface-side region 107 is large. By eliminating or making the above-described difference between the two refractive indices as small as possible, the boundary portion between the surface-side region 107 and the change region 106 in the surface layer 105 can reduce the amount of the reflection light there. Therefore, the maximal value of the above-described ratio (C/(Si+C)) in the change region 106 can be in a range of 0.25 or more and 0.50 or less, and further be in a range of 0.30 or more and 0.50 or less. On the other hand, the change region 106 is formed from the a-SiC as has been described above, and accordingly the minimum value of the above-described ratio (C/(Si+C)) in the change region 106 is larger than 0.00.

In addition, the change region 106 in the surface layer 105 is a region in which the above-described ratio (C/(Si+C)) gradually increases toward the surface side of the photosensitive member 100 from the photoconductive layer 104 side, as has been described above. As has been described above, as the above-described ratio (C/(Si+C)) increases, the refractive index of the a-SiC shows a tendency to decrease. However, in the change region 106, the above-described ratio (C/(Si+C)) is gradually increased toward the surface side of the photosensitive member 100 from the photoconductive layer 104 side, and accordingly the amount of the reflection light in the change region 106 can be reduced.

FIGS. 2A, 2B, 2C and 2D are views illustrating examples of the distribution of a carbon atom in the change region 106.

FIGS. 2A, 2B, 2C and 2D illustrate the ways of gradually increasing the above-described ratio (C/(Si+C)). The examples illustrated in FIGS. 2A, 2B, 2C and 2D are examples in which the change region 106 and the surface-side region 107 are provided in the surface layer 105, similarly to the examples illustrated in FIG. 1A and FIG. 1B. The surface of the surface-side region 107 becomes the surface of the photosensitive member 100, and the change region 106 comes in contact with the photoconductive layer 104. In FIGS. 2A, 2B, 2C and 2D, horizontal axes represent a distance from the boundary portion between the surface-side region 107 and the change region 106 to the boundary portion (boundary) between the change region 106 and the photoconductive layer 104. In FIGS. 2A, 2B, 2C and 2D, the left sides in the horizontal axes correspond to the surface-side region 107 side of the change region 106, and the right sides correspond to the photoconductive layer 104 side of the change region 106. In FIGS. 2A, 2B, 2C and 2D, vertical axes represent the above-described ratio (C/(Si+C)). In FIGS. 2A, 2B, 2C and 2D, the lines of the vertical axes correspond to the boundary portion between the surface-side region 107 and the change region 106, and dashed lines in the right sides correspond to the boundary portion (boundary) between the change region 106 and the photoconductive layer 104.

Figure 2A:
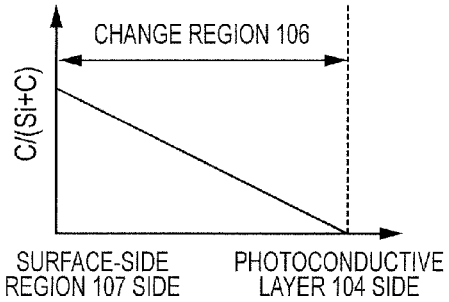
FIGS. 2A, 2B, 2C and 2D are views illustrating examples of the distribution of a carbon atom in a change region.
Figure 2B:
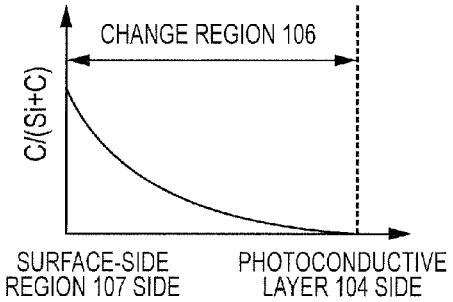
Figure 2C:
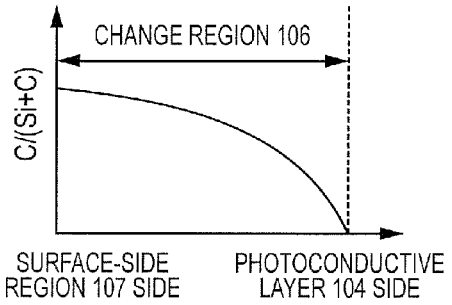
Figure 2D:
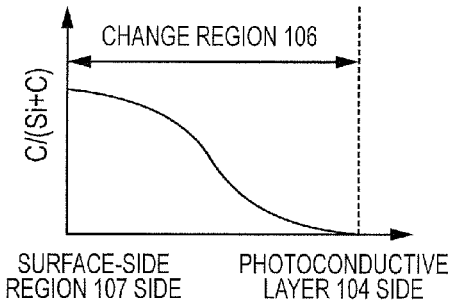

As is illustrated in FIG. 2A, the above-described ratio (C/(Si+C)) in the change region 106 may be linearly increased from the boundary portion (boundary) between the change region 106 and the photoconductive layer 104 to the boundary portion between the surface-side region 107 and the change region 106, and as illustrated in FIGS. 2B and 2C, the ratio (C/(Si+C)) may be curvilinearly increased from the boundary portion (boundary) between the change region 106 and the photoconductive layer 104 to the boundary portion between the surface-side region 107 and the change region 106. In addition, as illustrated in FIG. 2D, the above-described ratio (C/(Si+C)) in the change region 106 may gradually increase in a form of a mixture of the curvilinear gradual increase and the linear increase, from the boundary portion (boundary) between the change region 106 and the photoconductive layer 104 to the boundary portion between the surface-side region 107 and the change region 106.

When the surface of the surface-side region 107 in the surface layer 105 is the surface of the photosensitive member 100, there is a difference between the refractive index of the surface-side region 107 which is formed from the a-SiC and the refractive index of the atmosphere, and accordingly the reflection light is generated on the surface of the surface-side region 107.

When such the photosensitive member 100 is mounted on the electrophotographic apparatus and images are repeatedly output therefrom, the surface of the surface-side region 107 in the surface layer 105 is gradually worn due to the sliding of the surface-side region 107 with a transfer material (paper or the like), a toner, a contact member (cleaning blade or the like) and the like, and the thickness of the surface-side region 107 changes.

In addition, when the sliding situations are different depending on portions, there is the case where the thicknesses of the surface-side region 107 become different depending on sites.

If the reflection light is generated in the boundary portion between the surface-side region 107 and the change region 106 in the surface layer 105, in the boundary portion (boundary) between the photoconductive layer 104 and the change region 106, or in the change region 106, the reflection light results in causing interference with reflection light generated on the surface of the surface-side region 107.

At this time, when the thicknesses of the surface-side region 107 are different depending on sites, the above-described interference becomes uneven, and the amount of the reflection light on the surface of the photosensitive member 100 becomes uneven. As a result, the luminous sensitivity of the photosensitive member 100 is different depending on sites of the surface of the photosensitive member 100. Specifically, there is the case where the luminous sensitivity becomes uneven.

The a-Si photosensitive member (photosensitive member 100) of the present invention can reduce the amount of the reflection light to be generated on the boundary portion between the surface-side region 107 and the change region 106 in the surface layer 105, the amount of the reflection light to be generated on the boundary portion (boundary) between the change region 106 in the surface layer 105 and the photoconductive layer 104, and the amount of the reflection light in the change region 106. The a-Si photosensitive member reduces the amounts of reflection light at the boundaries and the region, and thereby being able to reduce the unevenness of the luminous sensitivity of the above-described photosensitive member.

The thickness of the change region 106 can be 0.3 to 2.0 μm, further be 0.4 to 1.5 μm, and still further be 0.5 to 1.0 μm. As the thickness of the change region 106 increases, it is easy to reduce the amount of the reflection light in the change region 106, the amount of the reflection light generated on the boundary portion between the surface-side region 107 and the change region 106 in the surface layer 105, and the amount of the reflection light generated on the boundary portion (boundary) between the change region 106 in the surface layer 105 and the photoconductive layer 104. In addition, as the thickness of the change region 106 decreases, the change region 106 is formed in a shorter period of time, and the manufacturing cost of the photosensitive member 100 tends to be easily reduced.

(Upper Charge Injection Prohibiting Portion 108 in Change Region 106)

In the present invention, the upper charge injection prohibiting portion 108 is provided in the change region 106 in the surface layer 105 as a portion of blocking an electric charge (negative electric charge) from being injected into the photoconductive layer 104 from the surface of the photosensitive member 100. The upper charge injection prohibiting portion 108 which is provided in the change region 106 formed from a-SiC is also formed from the a-SiC.

The a-SiC is an amorphous material that uses a hydrogen atom as an atom for compensating uncombined hands of the silicon atom and the carbon atom which are atoms for forming the skeleton, but a halogen atom may also be used in combination as the atom for compensating the uncombined hands of the silicon atom and the carbon atom. The suitable ranges of the content of the hydrogen atom and the content of the halogen atom in the a-SiC are similar to those in the case of the above-described surface-side region 107.

In the upper charge injection prohibiting portion 108, a Group 13 atom is further contained as an atom for controlling the electrical conduction property. The content of the Group 13 atom in the upper charge injection prohibiting portion 108 can be 0.1 to 3,000 atomic ppm with respect to the silicon atom in the a-SiC of the upper charge injection prohibiting portion 108, from the viewpoint of the capability of blocking an electric charge (negative electric charge) from being injected into the photoconductive layer 104 from the surface of the photosensitive member 100. As the content of the Group 13 atom increases, the P-type electrical conduction property is enhanced, and the capability of blocking an electric charge (negative electric charge) from being injected into the photoconductive layer 104 from the surface of the photosensitive member 100 is enhanced. In addition, as the content of the Group 13 atom decreases, the mobility of the positive hole in the thickness direction of the upper charge injection prohibiting portion 108 decreases, and accordingly the blurring in the output image resists occurring.

The thickness of the upper charge injection prohibiting portion 108 can be 0.01 to 0.3 μm, further be 0.03 to 0.15 μm, and still further be 0.05 to 0.1 μm, from the viewpoint of the electrophotographic characteristics. As the thickness of the upper charge injection prohibiting portion 108 increases, the capability of blocking an electric charge (negative electric charge) from being injected into the photoconductive layer 104 from the surface of the photosensitive member 100 is enhanced. In addition, as the thickness of the upper charge injection prohibiting portion 108 decreases, blurring in the output image resists occurring.

The Group 13 atoms contained in the upper charge injection prohibiting portion 108 include, for instance, a boron atom (B), an aluminum atom (Al), a gallium atom (Ga), an indium atom (In) and a thallium atom (Tl). Among the atoms, the boron atom (B) can be used.

The upper charge injection prohibiting portion 108 may be provided in any position in the change region 106. For instance, the upper charge injection prohibiting portion 108 may be provided so as to come in contact with the boundary portion (boundary) between the change region 106 and the photoconductive layer 104, may also be provided in the middle of the change region 106, and may also be provided so as to come in contact with the boundary portion between the surface-side region 107 and the change region 106. Among the positions, the upper charge injection prohibiting portion 108 can be provided in a portion at which the above-described (C/(Si+C)) in the change region 106 is more than 0.00 and 0.30 or less. As the above-described (C/(Si+C)) of the portion at which the upper charge injection prohibiting portion 108 in the change region 106 is provided decreases, the efficiency of making the Group 13 atom contained (doped) is enhanced, and the capability of the upper charge injection prohibiting portion 108 to block an electric charge (negative electric charge) from being injected into the photoconductive layer 104 from the surface of the photosensitive member 100 is enhanced.

Furthermore, in the present invention, in order to further enhance the capability of the upper charge injection prohibiting portion 108 to block an electric charge (negative electric charge) from being injected into the photoconductive layer 104 from the surface of the photosensitive member 100, the distribution of the Group 13 atom in the boundary portion between the surface-side portion 109 and the upper charge injection prohibiting portion 108 needs to be precipitous.

The distribution of the Group 13 atom in the boundary portion between the surface-side portion 109 which does not contain the Group 13 atom and the upper charge injection prohibiting portion 108 which contains the Group 13 atom will now be described below (steps (A1), (A2), (A3), (A4), (A5) and (A6)).

Firstly, a standard ionic strength $f(D_S)$ is determined by an SIMS analysis, and a precipitous property $\Delta Z$ is determined by using the standard ionic strength $f(D_S)$ (steps (A1), (A2), (A3) and (A4)).

Figure 3:
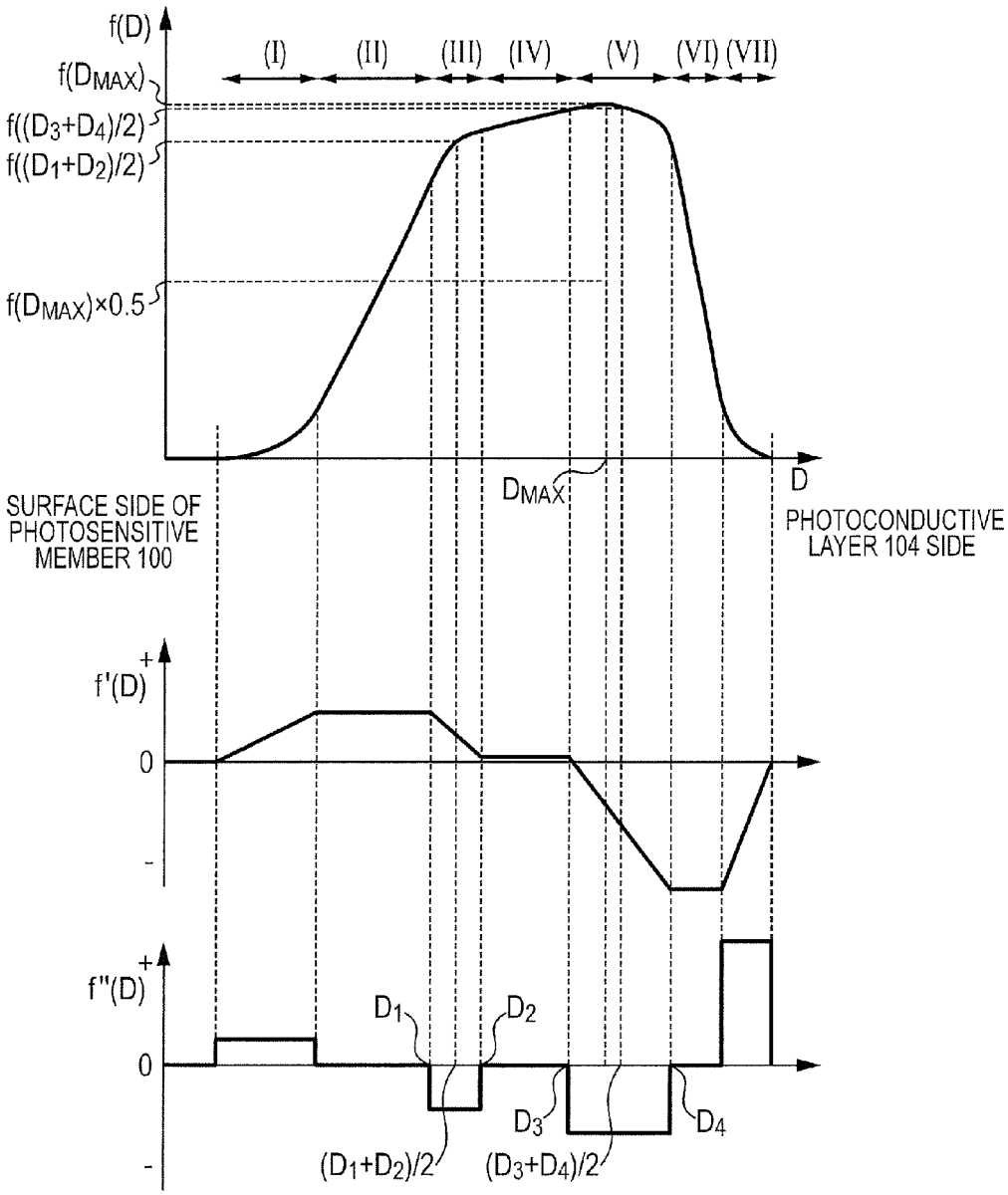
FIG. 3 is a view illustrating an example of the distribution (depth profile) of an ionic strength f(D) of a Group 13 atom in the change region, which is obtained by an SIMS analysis, a first order differential f'(D) of the ionic strength f(D), and a second order differential f''(D) of the ionic strength f(D).

FIG. 3 is a view illustrating an example of the distribution (depth profile) of an ionic strength f(D) of a Group 13 atom in the change region 106, which is obtained by the SIMS analysis, a first order differential f'(D) of the ionic strength f(D), and a second order differential f''(D) of the ionic strength f(D).

In each graph of the upper stage, the middle stage and the lower stage in FIG. 3, horizontal axes represent a distance D from the surface of the photosensitive member 100. The left sides in the horizontal axes are the surface side (surface-side region 107 side) of the photosensitive member 100, and the right sides in the horizontal axes are the photoconductive layer 104 side. In the graph of the upper stage in FIG. 3, the vertical axis represents the ionic strength f(D) of the Group 13 atom. In the graph of the middle stage in FIG. 3, the vertical axis represents the first order differential f'(D) of the ionic strength f(D). In the graph of the lower stage in FIG. 3, the vertical axis represents the second order differential f''(D) of the ionic strength f(D).

In the example illustrated in FIG. 3, when the D increases, specifically, when the position approaches the photoconductive layer 104 side from the surface side of the photosensitive member 100, the ionic strength f(D) of the Group 13 atom shows the distribution as in the following.

In the example illustrated in FIG. 3, the ionic strength f(D) of the Group 13 atom gradually increases (region (I) in the graph of the upper stage in FIG. 3) from 0 (which includes a detection limit or less), and the ionic strength f(D) of the Group 13 atom sharply increases from a certain point (region (II) in the same graph). After that, from a certain point, the ionic strength f(D) of the Group 13 atom increases while changing the degree of increase mild (regions (III) to (IV) in the same graph). Then, at a certain point, the ionic strength f(D) of the Group 13 atom reaches the maximal value $f(D_{MAX})$, and after that, mild decreases (region (V) in the same graph). After that, from a certain point, the ionic strength f(D) of the Group 13 atom sharply decreases (region (VI) in the same graph). After that, from a certain point, the ionic strength f(D) of the Group 13 atom decreases while changing the degree of decrease mild, and becomes 0 (region (VII) in the same graph).

An important point for the precipitous property of the distribution of the Group 13 atom is a place in which the ionic strength f(D) sharply increases and then changes the degree of the increase mild. In particular, a place becomes important which is closer to the surface-side region 107 (surface of the photosensitive member 100) of the upper charge injection prohibiting portion (portion which contains Group 13 atom) 108, in other words, a portion from the region (I) to the region (III) in the graph of the upper stage in FIG. 3 becomes important.

Generally, if the second order differential of a certain function is positive, the graph of the function projects downward, and if the second order differential is negative, the graph projects upward. Therefore, when the second order differential f''(D) of the ionic strength f(D) of the Group 13 atom is drawn as in the graph of the lower stage in FIG. 3, a point exists at which the f''(D) changes from f''(D)=0 to f''(D)<0. ($D_1$ and $D_3$ in the graph of the lower stage in FIG. 3)

In other words, a portion at which the ionic strength f(D) of the Group 13 atom projects upward exists in the vicinity of f''(D)<0 (regions (III) and (V) in the graph of the lower stage in FIG. 3), and a portion exists at which the degree of the increase changes in the distribution of the Group 13 atom.

Furthermore, when there is a peak in the ionic strength f(D) of the Group 13 atom after f''(D)<0, or when the ionic strength f(D) of the Group 13 atom constantly changes or mildly changes, the f''(D) passes through a point of f''(D)=0 at least once.

Therefore, a portion at which the increase rate of the distribution of the Group 13 atom changes exists in somewhere in portions at which the f''(D) changes from f''(D)=0 to f''(D)<0, and after that, the f''(D) passes from the f''(D)<0 to f''(D)=0 (from $D_1$ to $D_2$ and from $D_3$ to $D_4$ in the graph of the lower stage in FIG. 3).

In the present invention, the middle point $((D_1+D_2)/2)$ between $D_1$ and $D_2$ and the middle point $((D_3+D_4)/2)$ between $D_3$ and $D_4$ are defined as change points.

However, as in the example illustrated in FIG. 3, there is the case where a plurality of change points exists. In this case, a point ($(D_1+D_2)/2$ in FIG. 3) becomes important which is closer to the surface-side region 107 (surface of photosensitive member 100).

In the present invention, when viewed from the surface (surface-side region 107) of the photosensitive member 100, a distance between a point at which the f''(D) firstly changes from f''(D)=0 to f''(D)<0 and the surface of the photosensitive member 100 is defined as $D_A$. Then, a distance between a point at which the f''(D) changes from f''(D)<0 to f''(D)=0 and the surface of the photosensitive member 100 is defined as $D_B$. In the case of the example illustrated in FIG. 3, $D_1$ becomes $D_A$, and $D_2$ becomes $D_B$. In addition, the ionic strength $f((D_A+D_B)/2)$ ($f((D_1+D_2)/2)$ in the example illustrated in FIG. 3) of the change point $(D_A+D_B)/2$ ($(D_1+D_2)/2$ in the example illustrated in FIG. 3) is defined as a standard ionic strength $f(D_S)$ of the Group 13 atom. $D_S$ is a distance between a position at which the ionic strength of the Group 13 atom reaches the standard ionic strength $f(D_S)$ and the surface of the photosensitive member 100.

Among portions in the change region 106, portions in the surface-side region 107 side from the point at which the distance from the surface of the photosensitive member 100 is $D_S$ result in being portions in which the distribution of the Group 13 atom sharply changes.

Figure 4:
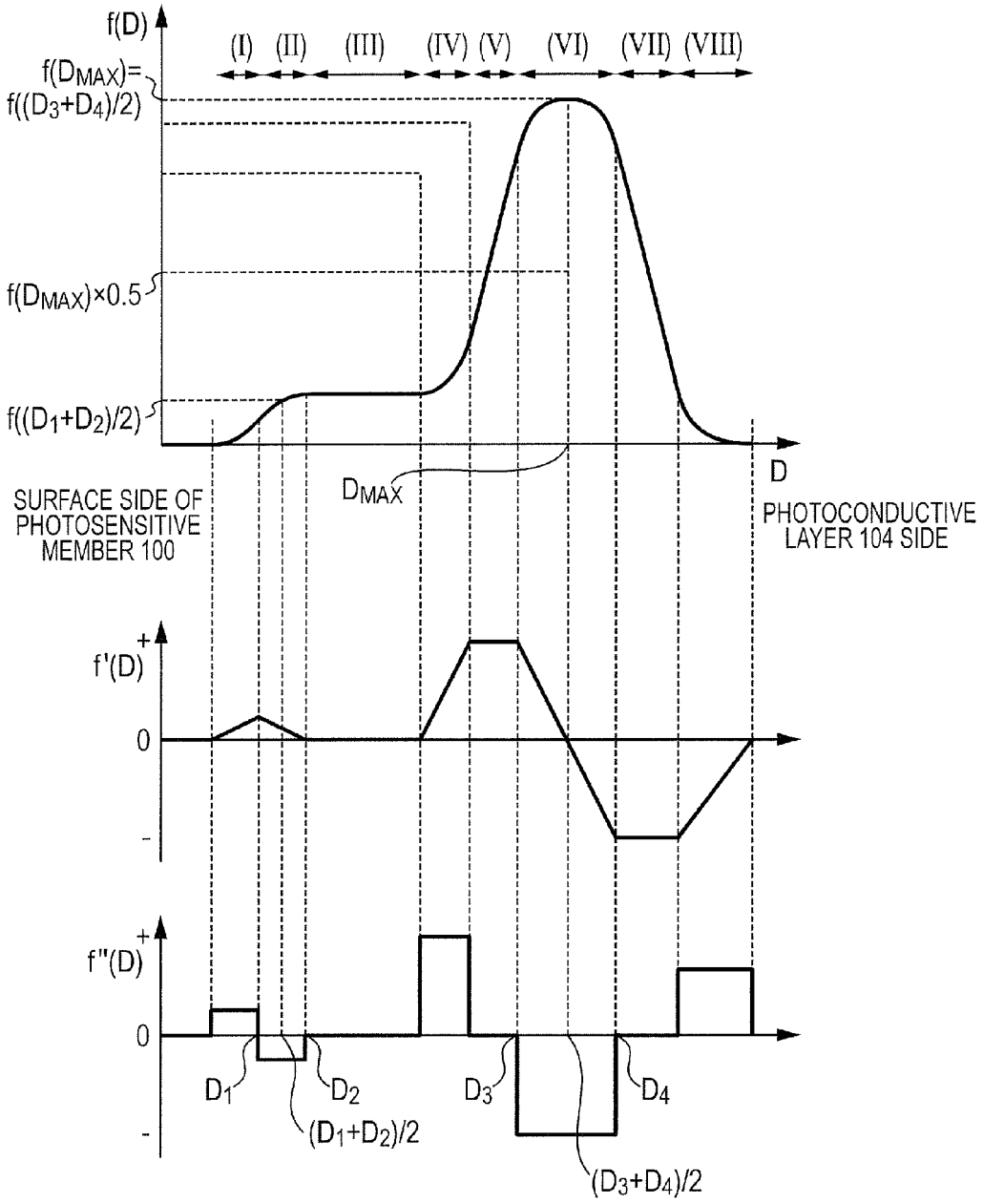
FIG. 4 is a view illustrating another example of the distribution (depth profile) of the ionic strength f(D) of the Group 13 atom in the change region, which is obtained by the SIMS analysis, the first order differential f'(D) of the ionic strength f(D), and the second order differential f''(D) of the ionic strength f(D).

FIG. 4 is a view illustrating another example of the distribution (depth profile) of the ionic strength f(D) of the Group 13 atom in the change region 106, which is obtained by the SIMS analysis, the first order differential f'(D) of the ionic strength f(D), and the second order differential f''(D) of the ionic strength f(D).

Also in each graph of the upper stage, the middle stage and the lower stage in FIG. 4, horizontal axes represent a distance D from the surface of the photosensitive member 100, the left sides in the horizontal axes are the surface side (surface-side region 107 side) of the photosensitive member 100, and the right sides in the horizontal axes are the photoconductive layer 104 side.

In the graph of the upper stage in FIG. 4, the vertical axis represents the ionic strength f(D) of the Group 13 atom.

In the graph of the middle stage in FIG. 4, the vertical axis represents the first order differential f'(D) of the ionic strength f(D).

In the graph of the lower stage in FIG. 4, the vertical axis represents the second order differential f''(D) of the ionic strength f(D).

In the example illustrated in FIG. 4, when the D increases, specifically, when the position approaches the photoconductive layer 104 side from the surface side of the photosensitive member 100, the ionic strength f(D) of the Group 13 atom shows the distribution as in the following.

In the example illustrated in FIG. 4, the ionic strength f(D) of the Group 13 atom gradually increases (region (I) in the graph of the upper stage in FIG. 4) from 0 (which includes a detection limit or less), and after that, the ionic strength f(D) of the Group 13 atom increases from a certain point while changing a degree of increase mild (region (II) in the same graph). After that, the ionic strength f(D) of the Group 13 atom becomes constant for a while (region (III) in the same graph). After that, the ionic strength f(D) of the Group 13 atom gradually increases again from a certain point (region (IV) in the same graph), and the ionic strength f(D) of the Group 13 atom sharply increases from a certain point (region (V) in the same graph). After that, the ionic strength f(D) of the Group 13 atom increases from a certain point while changing a degree of increase mild, and the ionic strength f(D) of the Group 13 atom reaches the maximal value $f(D_{MAX})$ at a certain point, and after that, mildly decreases (region (VI) in the same graph). After that, the ionic strength f(D) of the Group 13 atom sharply decreases from a certain point (region (VII) in the same graph). After that, the ionic strength f(D) of the Group 13 atom decreases from a certain point while changing a degree of decrease mild, and becomes 0 (region (VIII) in the same graph).

In the case of the graph of the lower stage in FIG. 4, points at which the f''(D) changes from f''(D)=0 to f''(D)<0 are $D_1$ and $D_3$, and points at which the f''(D) changes from f''(D)<0 to f''(D)=0 are $D_2$ and $D_4$.

In the graph of the upper stage in FIG. 4, it is tentatively considered that the portion of the region (I) and the portions from the region (IV) to the region (V) are important, from the same reason as that in the above-described example in FIG. 3.

However, the portion of the region (I) gives a less influence on the charging ability when the a-Si photosensitive member is negatively electrified.

The reason is considered as follows.

As has been described above, the upper charge injection prohibiting portion 108 is made to contain the Group 13 atom and have the P-type electrical conduction property, so as to block the electric charge (negative electric charge) from being injected into the photoconductive layer from the surface of the photosensitive member. For this reason, the upper charge injection prohibiting portion 108 needs to contain a certain amount of the Group 13 atom. The needed content is the $f(D_{MAX})$ which is the maximal value of the ionic strength f(D) of the Group 13 atom, as an approximate standard value. Therefore, even though there is a place in which the ionic strength f(D) sharply increases, and then changes the degree of the increase mild in a portion at which the content of the Group 13 atom is extremely small compared to that in $f(D_{MAX})$, the place gives a less influence on the charging ability when the a-Si photosensitive member is negatively electrified.

Accordingly, the standard ionic strength $f(D_S)$ is defined not only by the above-described conditions (conditions described in example of FIG. 3), but also a relationship between the standard ionic strength $f(D_S)$ and $f(D_{MAX})$ becomes a necessary condition for the definition.

As a result of having made an investigation, the present inventors have found that even though there is a place in which the ionic strength f(D) sharply increases, and then changes the degree of the increase mild in a portion at which the content of the Group 13 atom is less than 50% of $f(D_{MAX})$, the place gives a less influence on the charging ability when the a-Si photosensitive member is negatively electrified.

Therefore, in the case of the example shown in FIG. 4, $D_3$ becomes $D_A$ and $D_4$ becomes $D_B$. In addition, the ionic strength $f((D_3+D_4)/2))$ of the change point $(D_3+D_4)/2$ becomes the standard ionic strength $f(D_S)$ of the Group 13 atom.

When the above description is summarized, the standard ionic strength $f(D_S)$ is defined as follows.

In the depth profile (distribution of the ionic strength f(D) of the Group 13 atom in the change region 106, which is obtained by the SIMS analysis), a distance from the surface of the photosensitive member 100 shall be represented by D, an ionic strength of the Group 13 atom at the distance D shall be represented by a function f(D) of the distance D, the maximal value of the f(D) shall be represented by $f(D_{MAX})$, a second order differential of f(D) shall be represented by f''(D), a distance of a point at which f''(D) changes from f''(D)=0 to f''(D)<0 when the D is increased toward the photoconductive layer, from the surface of the electrophotographic photosensitive member, shall be represented by $D_A$, and a distance of a point at which f''(D) subsequently changes from f''(D)<0 to f''(D)=0, from the surface of the electrophotographic photosensitive member, shall be represented by $D_B$. In addition, among the distances D which satisfy $f((D_A+D_B)/2)\geq f(D_{MAX})\times 0.5$, the first distance when the above-described upper charge injection prohibiting portion is viewed from the surface of the electrophotographic photosensitive member shall be represented by $D_S$, and the ionic strength f(D) of the Group 13 atom at the distance $D_S$ shall be represented by a standard ionic strength $f(D_S)$. Accordingly, in the example illustrated in FIG. 3, $D_1$ becomes $D_A$ and $D_2$ becomes $D_B$. In addition, in the example illustrated in FIG. 4, $D_3$ becomes $D_A$ and $D_4$ becomes $D_B$. In the example illustrated in FIG. 4, $D_1$ and $D_2$ do not satisfy $f((D_1+D_2)/2)\geq f(D_{MAX})\times 0.5$, and accordingly $D_1$ does not become $D_A$, and $D_2$ does not become $D_B$.

Next, a precipitous property ΔZ is determined by using the standard ionic strength $f(D_S)$, from the SIMS analysis.

Figure 5:
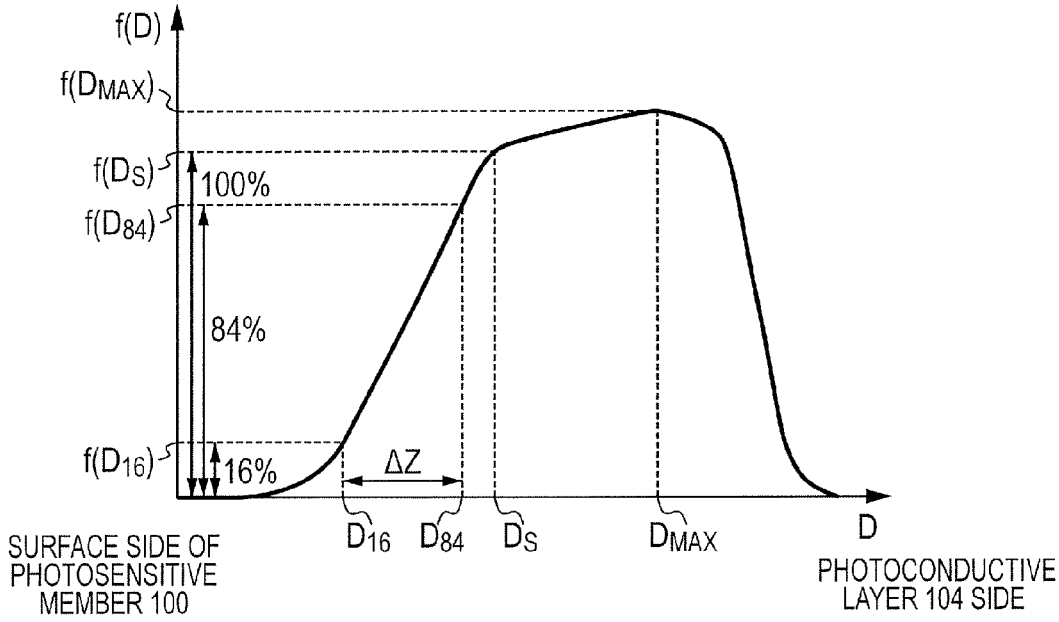
FIG. 5 is a view illustrating an example of the distribution (depth profile) of the ionic strength of the Group 13 atom in the change region, which is obtained by the SIMS analysis.

FIG. 5 is a view illustrating an example of the distribution (depth profile) of the ionic strength of the Group 13 atom in the change region 106, which is obtained by the SIMS analysis.

In the graph in FIG. 5, a horizontal axis represents a distance D from the surface of the photosensitive member 100. The left side in the horizontal axis is the surface side (surface-side region 107 side) of the photosensitive member 100, and the right side in the horizontal axis is the photoconductive layer 104 side. In addition, in the graph in FIG. 5, a vertical axis represents the ionic strength f(D) of the Group 13 atom. The distribution (depth profile) of the ionic strength of the Group 13 atom in FIG. 5 is the same as the distribution (depth profile) of the ionic strength of the Group 13 atom in the upper stage of FIG. 3.

In FIG. 5, the $f(D_{MAX})$ is the maximal value of the ionic strength f(D) of the Group 13 atom, as has been described above. $D_{MAX}$ is a distance between a position at which the ionic strength of the Group 13 atom becomes $f(D_{MAX})$ and the surface of the photosensitive member 100.

In addition, in FIG. 5, $f(D_{84})$ is 84% of the ionic strength when the standard ionic strength $f(D_S)$ is determined to be 100%. In other words, $f(D_{84})=f(D_S)\times 0.84$ holds. $D_{84}$ is a distance between a position at which the ionic strength of the Group 13 atom becomes $f(D_{84})$ and the surface of the photosensitive member 100. In addition, $f(D_{16})$ is 16% of the ionic strength when the standard ionic strength $f(D_S)$ is determined to be 100%. In other words, $f(D_{16})=f(D_S)\times 0.16$ holds. $D_{16}$ is a distance between a position at which the ionic strength of the Group 13 atom becomes $f(D_{16})$ and the surface of the photosensitive member 100.

$\Delta Z$ is an indicator which represents the precipitous property of the distribution of the Group 13 atom in the a-Si photosensitive member to be evaluated, and is a distance in a depth direction (thickness direction), in which the ionic strength f(D) of the Group 13 atom changes from $f(D_{16})$ to $f(D_{84})$. In other words, $\Delta Z=|D_{84}-D_{16}|$ holds.

On the other hand, a precipitous property $\Delta Z_0$ in the standard laminated film A is determined by the SIMS analysis ((A5) and (A6)).

In the present invention, it is essential to equalize the measurement conditions of the SIMS analysis to be conducted when the precipitous property $\Delta Z_0$ in the standard laminated film A is determined, with the above-described measurement conditions of the SIMS analysis which is conducted for the photosensitive member 100. Specifically, it is necessary to fix the measurement conditions when the precipitous property $\Delta Z$ is determined and when the precipitous property $\Delta Z_0$ is determined.

This is because if the SIMS analysis is not conducted on the same measurement conditions, for instance, even when a plurality of SIMS analyses are conducted for the same sample, there is the case where the obtained results (depth profile of the ionic strength of the Group 13 atom) vary. This is because even when the precipitous property $\Delta Z$ on the photosensitive member is compared with the precipitous property $\Delta Z_0$ on the standard laminated film A, there is a possibility that the precipitous property of the distribution of the Group 13 atom and consequently the charging ability when the a-Si photosensitive member is negatively electrified cannot be accurately evaluated, which will be described later.

Firstly, as has been described above, a standard laminated film A is produced which has a film (film $A_1$) that has a composition corresponding to the upper charge injection prohibiting portion 108 in the change region 106 of the photosensitive member 100, and a film (film $A_2$) that has a composition corresponding to the surface-side portion 109 in the change region 106, stacked in this order. The film $A_1$ uniformly contains the Group 13 atom. The film $A_2$ does not contain the Group 13 atom.

When the standard laminated film A is produced, the production method should be minded so that the distribution of the Group 13 atom theoretically becomes precipitous in the boundary portion (boundary) between the film $A_2$ which does not contain the Group 13 atom and the film $A_1$ which contains the Group 13 atom.

Figure 6:
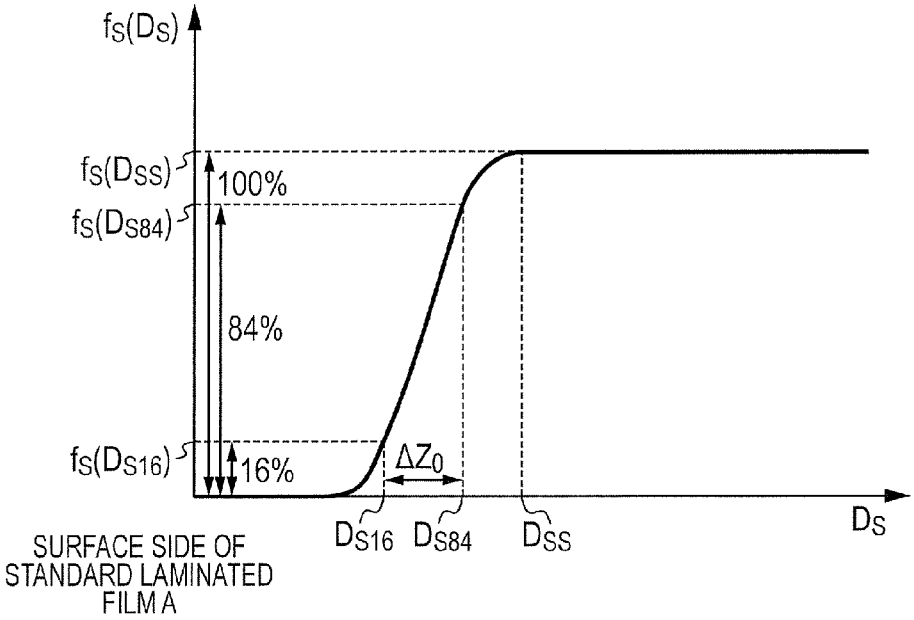
FIG. 6 is a view illustrating an example of the distribution (depth profile) of the ionic strength of the Group 13 atom in a standard laminated film A, which is obtained by the SIMS analysis.

FIG. 6 is a view illustrating an example of the distribution (depth profile) of the ionic strength of the Group 13 atom in the standard laminated film A, which is obtained by the SIMS analysis.

In the graph in FIG. 6, a horizontal axis represents a distance $D_S$ from the surface (surface of film $A_2$) of the standard laminated film A. The left side in the horizontal axis is a side of the film $A_2$ which does not contain the Group 13 atom, and the right side in the horizontal axis is a side of the film $A_1$ which contains the Group 13 atom. In addition, in the graph in FIG. 6, a vertical axis represents the ionic strength $f_S(D_S)$ of the Group 13 atom. The standard laminated film A in the example illustrated in FIG. 6 is a standard laminated film A corresponding to the photosensitive member 100 in which the distribution of the ionic strength f(D) of the Group 13 atom in the change region 106 becomes the distribution illustrated in FIG. 3.

The film $A_1$ of the standard laminated film A corresponding to the photosensitive member 100 in which the distribution of the ionic strength f(D) of the Group 13 atom in the change region 106 becomes the distribution illustrated in FIG. 3 contains the Group 13 atom so that the standard ionic strength $f_S(D_{SS})$ becomes equal to the standard ionic strength $f(D_S)$. In other words, $f(D_S)=f_S(D_{SS})$ holds.

Other conditions are similar to those in the above-described FIG. 3, and $f_S(D_{S84})$ in FIG. 6 is an ionic strength which becomes 84% when the standard ionic strength $f_S(D_{SS})$ is determined to be 100%. In other words, $f_S(D_{S84})=f_S(D_{SS})\times 0.84$ holds. The $D_{S84}$ is a distance between a position at which the ionic strength of the Group 13 atom becomes $f_S(D_{S84})$ and the surface of the standard laminated film A. In addition, $f_S(D_{S16})$ is an ionic strength which becomes 16% when the standard ionic strength $f_S(D_{SS})$ is determined to be 100%. In other words, $f_S(D_{S16})=f_S(D_{SS})\times 0.16$ holds. $D_{S16}$ is a distance between a position at which the ionic strength of the Group 13 atom becomes $f_S(D_{S16})$ and the surface of the standard laminated film A.

$\Delta Z_0$ is an indicator which represents the precipitous property of the distribution of the Group 13 atom in the standard laminated film A, and is a distance in a depth direction (thickness direction), in which the ionic strength $f_S(D_S)$ of the Group 13 atom changes from $f(D_{S16})$ to $f(D_{S84})$. In other words, $\Delta Z_0=|D_{S84}-D_{S16}|$ holds.

In addition, the ionic strength which becomes 50% when $f(D_S)$ in the a-Si photosensitive member to be evaluated is determined to be 100% shall be represented by $f(D_{50})$ (not-shown). In addition, a distance between a position at which the ionic strength of the Group 13 atom becomes $f(D_{50})$ and the surface of the photosensitive member 100 shall be represented by $D_{50}$ (not-shown).

As has been described above, the film $A_1$ of the standard laminated film A is a film which has a composition corresponding to the upper charge injection prohibiting portion in the change region of the a-Si photosensitive member to be evaluated.

In addition, as has been described above, in order to enhance the charging ability when the a-Si photosensitive member is negatively electrified, it is important to control the precipitous property of the distribution of the Group 13 atom to a specific range (to control distribution so as to be as precipitous as possible). For this purpose, it is necessary to accurately evaluate the distribution of the Group 13 atom in the boundary portion between the surface-side portion and the upper charge injection prohibiting portion in the change region in the surface layer of the photosensitive member. For this purpose, it is considered that the compositions of the film $A_1$ and the film $A_2$ of the standard laminated film A should be equalized to the compositions of the upper charge injection prohibiting portion and the surface-side portion in the change region in the surface layer of the a-Si photosensitive member to be evaluated, respectively.

The contents of the silicon atom, the carbon atom, the hydrogen atom, and the Group 13 atom in the upper charge injection prohibiting portion and the surface-side portion in the change region in the surface layer of the a-Si photosensitive member to be evaluated can be determined by the SIMS analysis.

However, the surface layer of the a-Si photosensitive member to be evaluated is formed from the a-SiC which is formed from a base material (main constituent atom) including a silicon atom, a carbon atom and a hydrogen atom. Because of this, it is often difficult to determine an accurate content by a method of determining the contents by calculating a relative sensitive factor (RSF), in a quantitative analysis of determining the contents of the silicon atom, the carbon atom and the hydrogen atom, because a matrix effect remarkably appears therein. In such a case, it is possible to accurately determine the contents of the silicon atom, the carbon atom and the hydrogen atom, by using $Cs^+$ as a primary ion in the SIMS analysis, and detecting a molecular ion $CsX^+$ that is combined with a target atom (which shall be represented by X) as a secondary ion.

In the case of the a-SiC which forms the base material of the upper charge injection prohibiting portion 108 of the photosensitive member of the present invention, a several types of standard samples of the a-SiC are used in which the contents (concentration: atom %) of the silicon atom, the carbon atom and the hydrogen atom have been determined by an RBS method and an HFS method. Then, calibration curves are determined on respective measurement conditions of the SIMS analysis, and the contents of the silicon atom, the carbon atom and the hydrogen atom can be determined.

Specifically, firstly, a ratio of hydrogen atoms/silicon atoms is determined with the measurement in the negative mode of $Cs^+$. Then, a ratio of carbon atoms/silicon atoms is determined with the measurement in the positive mode of $Cs^+$. Thereby, finally, the contents of the silicon atom, the carbon atom and the hydrogen atom can be determined.

The ionic strength of the Group 13 atom obtained by the SIMS analysis varies depending on the distance from the surface of photosensitive member 100, but as a result of having examined the result of the SIMS analysis, the present inventors have found that when a position at which the standard ionic strength $f(D_S)$ of the Group 13 atom becomes half is defined as the boundary between the film $A_1$ and the film $A_2$ of the standard laminated film A, the analysis result excellently corresponds with the charging ability shown when the a-Si photosensitive member to be evaluated is negatively electrified.

When the above description is summarized, the film $A_1$ and the film $A_2$ of the standard laminated film A are layers which contain the silicon atom, the carbon atom and the hydrogen atom of the same contents as the contents of the silicon atom, the carbon atom and the hydrogen atom at a position of which distance from the surface of the a-Si photosensitive member to be evaluated is $D_{50}$. Furthermore, the film $A_1$ of the standard laminated film A further contains the Group 13 atom so that the standard ionic strength $f_S(D_{SS})$ becomes equal to the standard ionic strength $f(D_S)$.

Thereby, the standard laminated film A becomes suitable for an accurate evaluation of the precipitous property of the distribution of the Group 13 atom in the boundary portion between the surface-side portion and the upper charge injection prohibiting portion in the change region in the surface layer of the a-Si photosensitive member, through relative comparison with the measurement result of the SIMS analysis in the a-Si photosensitive member to be evaluated.

Furthermore, as has been described above, the distribution of the Group 13 atom needs to be theoretically precipitous in the boundary portion (boundary) between the film $A_2$ which does not contain the Group 13 atom and the film $A_1$ which contains the Group 13 atom, in the standard laminated film A, and when the standard laminated film A is produced, the point should be minded.

As a result of having made an investigation, the present inventors have found that when the standard laminated film A is produced, for instance, in the following way, the distribution of the Group 13 atom becomes sufficiently precipitous in the boundary portion (boundary) between the film $A_2$ which does not contain the Group 13 atom and the film $A_1$ which contains the Group 13 atom (the Group 13 atom sharply increases toward the film $A_1$ side from the film $A_2$ side.).

Firstly, the film $A_1$ is formed in a reaction vessel.

After that, the introduction of source gases for forming the film $A_1$ (source gas for supplying silicon atom, source gas for supplying carbon atom and source gas for supplying Group 13 atom (if necessary, source gas for supplying hydrogen atom, and the like)) into a reaction vessel, and/or the introduction of an energy for decomposing the source gases are stopped. When the standard laminated film A is produced with a high-frequency plasma CVD method or a high-frequency sputtering method, the formation of the film $A_1$ is stopped by stopping the introduction of a high-frequency power into the reaction vessel. In addition, at this time, after the introduction of the source gases for forming the film $A_1$ has been stopped, the source gas for supplying the Group 13 atom can be exhausted from the inside of the reaction vessel so that the source gas for supplying the Group 13 atom does not remain in the reaction vessel.

After that, the film $A_2$ which does not contain the Group 13 atom is formed on the film $A_1$. The source gas for supplying the Group 13 atom is not supplied into the reaction vessel.

By the above operation, the standard laminated film A can be produced in which the distribution of the Group 13 atom is precipitous.

$\Delta Z_0$ of the thus produced standard laminated film A and $\Delta Z$ of the a-Si photosensitive member to be evaluated are obtained by the SIMS analysis on the same measurement condition, and the $\Delta Z_0$ and the $\Delta Z$ are compared with each other (value of $\Delta Z/\Delta Z_0$ is checked). In the present invention, this method is referred to as "evaluation method A of precipitous property of distribution of Group 13 atom" as well.

In the present invention, $\Delta Z/\Delta Z_0$ is 1.0 or more and 3.0 or less ($1.0 \leq \Delta Z/\Delta Z_0 \leq 3.0$). Theoretically, the minimal value of $\Delta Z/\Delta Z_0$ becomes 1.0. The fact that $\Delta Z/\Delta Z_0$ exceeds 3.0 means that the Group 13 atom does not sufficiently precipitously change in the boundary portion between the surface-side portion and the upper charge injection prohibiting portion in the change region in the surface layer of the a-Si photosensitive member (the Group 13 atom does not increase sharply but increases gradually toward the upper charge injection prohibiting portion side from the surface-side portion side, in the boundary portion.). Then, the change region results in being incapable of sufficiently blocking the electric charge (electron) from being injected into the photoconductive layer from the surface of the photosensitive member.

In addition, in the present invention, when the photoconductive layer-side portion 110, the upper charge injection prohibiting portion 108, and the surface-side portion 109 exist in the change region 106, for instance, as is illustrated in FIG. 1A, the distribution of the Group 13 atom can also be precipitous in the boundary portion between the photoconductive layer-side portion 110 and the upper charge injection prohibiting portion 108 (the Group 13 atom sharply decreases toward the side of photoconductive layer-side portion 110 from the side of the upper charge injection prohibiting portion 108), from the viewpoint of the charging ability when the a-Si photosensitive member is negatively electrified.

In addition, when the upper charge injection prohibiting portion 108 and the surface-side portion 109 exist in the change region 106, and the photoconductive layer-side portion 110 does not exist therein, for instance, as is illustrated in FIG. 1B, in other words, when the upper charge injection prohibiting portion 108 is the portion in the surface layer 105, which is the closest to the photoconductive layer 104 side, the distribution of the Group 13 atom can also be precipitous in the boundary portion between the photoconductive layer 104 and the upper charge injection prohibiting portion 108 (the Group 13 atom sharply decreases toward the photoconductive layer 104 side from the change region 106 side in the surface layer 105.), from the viewpoint of the charging ability when the a-Si photosensitive member is negatively electrified.

In both cases, specifically concerning $\Delta Y$ and $\Delta Y_0$ which will be determined with a method to be described later, $\Delta Y/\Delta Y_0$ can be 1.0 or more and 3.0 or less ($1.0 \leq \Delta Y/\Delta Y_0 \leq 3.0$). Theoretically, the minimal value of $\Delta Y/\Delta Y_0$ becomes 1.0. The fact that $\Delta Y/\Delta Y_0$ exceeds 3.0 means that the Group 13 atom does not sufficiently precipitously change in the boundary portion between the photoconductive layer of the a-Si photosensitive member or photoconductive layer-side portion in the change region in the surface layer and the upper charge injection prohibiting portion in the change region in the surface layer (the Group 13 atom does not decrease sharply but decreases gradually toward the side of the photoconductive layer-side portion or photoconductive layer side from the upper charge injection prohibiting portion side, in the boundary portion). In the present invention, the above method is referred to as "evaluation method B of precipitous property of distribution of Group 13 atom" as well.

The present inventors assume the reason why the above-described distribution of the Group 13 atom in the boundary portion between the photoconductive layer 104 or photoconductive layer-side portion 110 and the upper charge injection prohibiting portion 108 can also be precipitous, in the following way.

In the present invention, the change region 106 in the surface layer 105 of the photosensitive member 100 is a region in which a ratio (C/(Si+C)) of the number of the carbon atoms (C) with respect to the sum of the number of the silicon atoms (Si) and the number of the carbon atoms (C) gradually increases toward the surface side (surface-side region 107 side) of the photosensitive member 100 from the photoconductive layer 104 side. In the boundary portion between the photoconductive layer 104 or photoconductive layer-side portion 110 and the upper charge injection prohibiting portion 108, the content of the carbon atom becomes comparatively small, and the composition is comparatively close to that of a-Si. Because of this, the boundary portion tends to easily generate a photocarrier due to its photoconductivity, as the photoconductive layer 104 does which is formed from a-Si, when image-exposing light or pre-exposure light has been incident thereon. When the surface of the photosensitive member 100 is negatively electrified, an electron out of photocarriers which have been generated by the incidence of the image-exposing light or the pre-exposure light by nature moves to the substrate 102 side. It is considered that when the Group 13 atom exists in the boundary portion at this time, the travelling properties of the electron are lowered, and accordingly when there are a large amount of the Group 13 atoms therein, the electron cannot sufficiently move to the substrate 102 side from the boundary portion and tends to easily remain in the boundary portion (boundary) or in between the boundary portion (boundary) and the substrate 102. It is considered that when the next surface of the photosensitive member 100 is negatively electrified in such a situation, the electron which has remained there as has been described in the above moves toward the substrate 102 side due to an electric field formed by the negative electrification, and thereby the lowering of the surface potential of the photosensitive member 100 is caused.

As a result of the investigation of the present inventors, the present inventors have found that the precipitous property of the distribution of the Group 13 atom in the boundary portion between the photoconductive layer 104 or photoconductive layer-side portion 110 and the upper charge injection prohibiting portion 108 can be accurately evaluated with a similar method to the above-described method for evaluating the precipitous property.

The distribution of the Group 13 atom in the boundary portion between the photoconductive layer 104 or photoconductive layer-side portion 110 and the upper charge injection prohibiting portion 108 will now be described below (steps (B1), (B2), (B3), (B4), (B5) and (B6)).

Firstly, a standard ionic strength $g(E_S)$ is determined by the SIMS analysis, and a precipitous property $\Delta Y$ is determined by using the standard ionic strength $g(E_S)$ (steps (B1), (B2), (B3) and (B4)).

Figure 9:
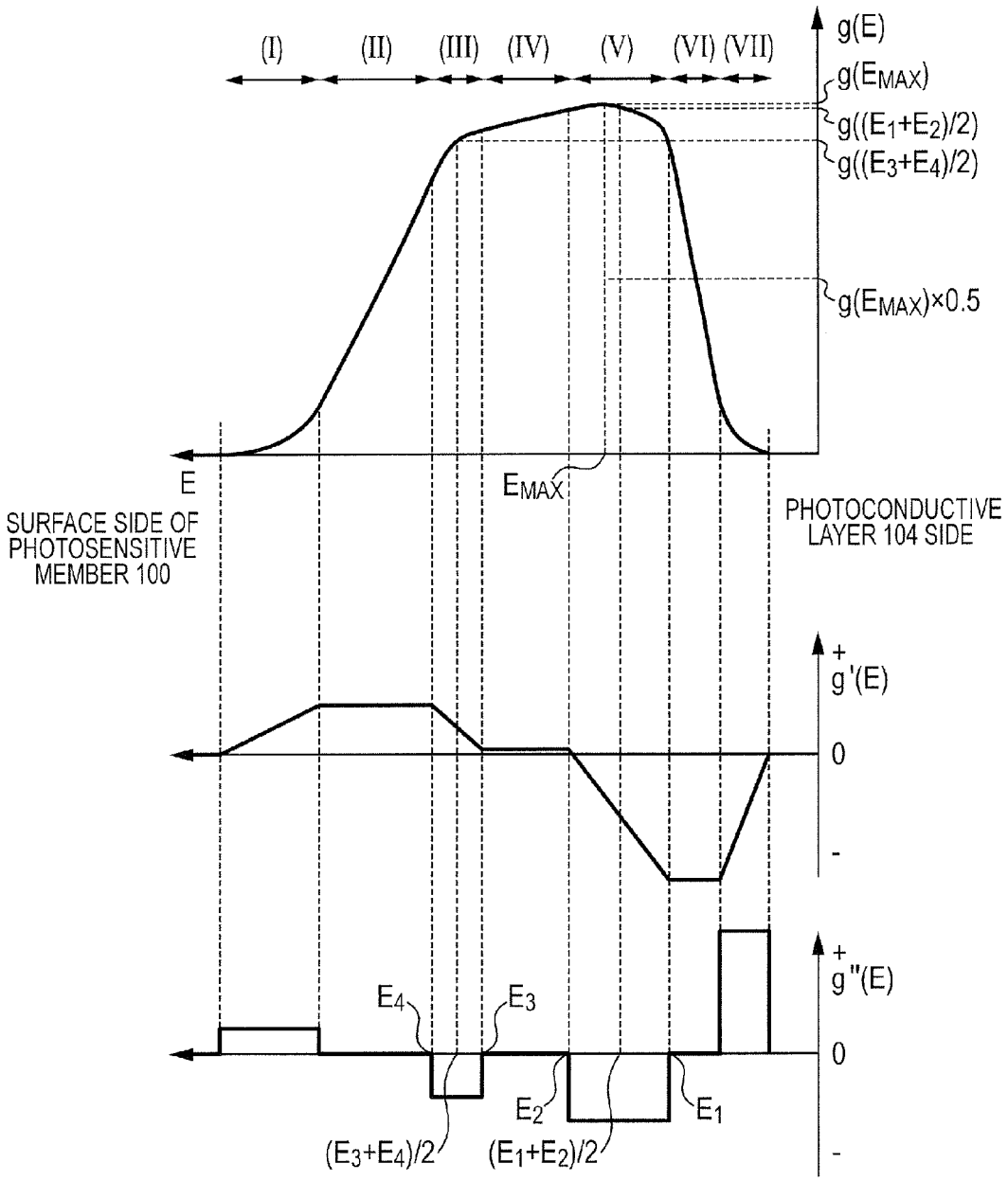
FIG. 9 is a view illustrating an example of the distribution (depth profile) of an ionic strength g(E) of the Group 13 atom in the change region, which is obtained by the SIMS analysis, a first order differential g'(E) of the ionic strength g(E), and a second order differential g''(E) of the ionic strength g(E).

FIG. 9 is a view illustrating an example of the distribution (depth profile) of an ionic strength g(E) of the Group 13 atom in the change region 106, which is obtained by the SIMS analysis, a first order differential g'(E) of the ionic strength g(E), and a second order differential g"(E) of the ionic strength g(E). The distribution (depth profile) of the ionic strength of the Group 13 atom and the like in FIG. 9 are the same as the distribution (depth profile) of the ionic strength of the Group 13 atom and the like in FIG. 3, but the symbols are changed for the sake of convenience of description.

In each graph of the upper stage, the middle stage and the lower stage in FIG. 9, horizontal axes represent a distance E from the boundary portion between the photoconductive layer 104 or photoconductive layer-side portion 110 and the upper charge injection prohibiting portion 108. The left sides in the horizontal axes are the surface side (surface-side region 107 side) of the photosensitive member 100, and the right sides in the horizontal axes are the photoconductive layer 104 side. In the graph of the upper stage in FIG. 9, the vertical axis represents the ionic strength g(E) of the Group 13 atom. In the graph of the middle stage in FIG. 9, the vertical axis represents the first order differential g'(E) of the ionic strength g(E). In the graph of the lower stage in FIG. 9, the vertical axis represents the second order differential g"(E) of the ionic strength g(E).

In the example illustrated in FIG. 9, when the E increases, specifically, when the position approaches the surface side of the photosensitive member 100 from the boundary portion side between the photoconductive layer 104 or photoconductive layer-side portion 110 and the upper charge injection prohibiting portion 108, the ionic strength g(E) of the Group 13 atom shows the distribution as in the following.

In the example illustrated in FIG. 9, the ionic strength g(E) of the Group 13 atom gradually increases (region (VII) in graph of upper stage in FIG. 9) from 0 (which includes a detection limit or less), and the ionic strength g(E) of the Group 13 atom sharply increases from a certain point (region (VI) in the same graph). After that, from a certain point, the ionic strength g(E) of the Group 13 atom increases while changing the degree of increase mild (region (V) in the same graph). Then, at a certain point, the ionic strength g(E) of the Group 13 atom reaches the maximal value $g(E_{MAX})$ (which is the same as $f(D_{MAX})$ in FIG. 3), and after that, mildly decreases (regions (IV) to (III) in the same graph). After that, the ionic strength g(E) of the Group 13 atom sharply decreases from a certain point (region (II) in the same graph). After that, from a certain point, the ionic strength g(E) of the Group 13 atom decreases while changing the degree of decrease mild, and becomes 0 (region (I) in the same graph).

An important point for the precipitous property of the distribution of the Group 13 atom is a place in which the ionic strength g(E) sharply increases and then changes the degree of the increase mild. In particular, a place becomes important which is closer to the photoconductive layer 104 or photoconductive layer-side portion 110 of the upper charge injection prohibiting portion (a portion which contains the Group 13 atom) 108, in other words, in the graph of the upper stage in FIG. 9, a portion from the region (VII) to a point which reaches the maximal value $g(E_{MAX})$ in the region (V) becomes important.

As has been described above, if the second order differential of a certain function is positive, the graph of the function projects downward, and if the second order differential is negative, the graph of the function projects upward. Therefore, when the second order differential g" (E) of the ionic strength g(E) of the Group 13 atom is drawn as in the graph of the lower stage in FIG. 9, a point exists at which the g"(E) changes from g"(E)=0 to g" (E)<0. ($E_1$ and $E_3$ in the graph of the lower stage in FIG. 9)

In other words, a portion at which the ionic strength g(E) of the Group 13 atom projects upward exists in the vicinity of a portion at which g" (E) is g" (E)<0 (regions (V) and (III) in the graph of the lower stage in FIG. 9), and a portion exists at which the degree of the increase changes in the distribution of the Group 13 atom.

Furthermore, when there is a peak in the ionic strength g(E) of the Group 13 atom after g"(E)<0, or when the ionic strength g(E) of the Group 13 atom constantly changes or mildly changes, the g"(E) passes through a point of g"(E)=0 at least once.

Therefore, a portion at which the increase rate of the distribution of the Group 13 atom changes exists in somewhere in portions at which the g"(E) changes from g"(E)=0 to g" (E)<0", and after that, the g" (E) passes from the g" (E)<0 to g" (E)=0 (from $E_1$ to $E_2$ and from $E_3$ to $E_4$ in the graph of the lower stage in FIG. 9).

In a similar way to the above description, the middle point $((E_1+E_2)/2)$ between $E_1$ and $E_2$ and the middle point $((E_3+E_4)/2)$ between $E_3$ and $E_4$ are defined as change points.

However, as in the example illustrated in FIG. 9, there is the case where a plurality of the change points exists. In this case, the point becomes important which is closer to the photoconductive layer 104 or the photoconductive layer-side portion 110 ($(E_1+E_2)/2$ in FIG. 9).

In the present invention, when viewed from the boundary portion between the photoconductive layer 104 or photoconductive layer-side portion 110 and the upper charge injection prohibiting portion 108, a distance between a point at which the g"(E) firstly changes from g"(E)=0 to g"(E)<0 and the boundary portion is defined as $E_A$. Then, a distance of a point at which the g"(E) changes from g"(E)<0 to g"(E)=0 after that, from the boundary portion between the photoconductive layer 104 or photoconductive layer-side portion 110 and the upper charge injection prohibiting portion 108, is defined as $E_B$. In the case of the example illustrated in FIG. 9, $E_1$ becomes $E_A$, and $E_2$ becomes $E_B$. In addition, the ionic strength $g((E_A+E_B)/2)$ ($g((E_1+E_2)/2)$ in the example illustrated in FIG. 9) of the change point $(E_A+E_B)/2$ ($(E_1+E_2)/2$ in the example illustrated in FIG. 9) is defined as a standard ionic strength $g(E_S)$ of the Group 13 atom. The $E_S$ is a distance of a position at which the ionic strength of the Group 13 atom reaches the standard ionic strength $g(E_S)$, from the boundary portion between the photoconductive layer 104 or photoconductive layer-side portion 110 and the upper charge injection prohibiting portion 108.

Among portions in the change region 106, portions in the side of the photoconductive layer 104 or photoconductive layer-side portion 110 from the point at which the distance from the boundary portion between the photoconductive layer 104 or photoconductive layer-side portion 110 and the upper charge injection prohibiting portion 108 is $E_S$ result in being portions in which the distribution of the Group 13 atom comparatively sharply changes.

In addition, similarly to the above-described the standard ionic strength $f(D_S)$, the standard ionic strength $g(E_S)$ is also not only defined by the above-described conditions (conditions described in example of FIG. 9), but also a relationship between the standard ionic strength $g(E_S)$ and the $g(E_{MAX})$ becomes a necessary condition for the definition.

Specifically, the standard ionic strength $g(E_S)$ is defined as follows.

In the depth profile (the distribution of the ionic strength g(E) of the Group 13 atom in the change region 106, which is obtained by the SIMS analysis), a distance from the boundary portion (boundary) between the photoconductive layer or photoconductive layer-side portion and the upper charge injection prohibiting portion shall be represented by E, an ionic strength of the Group 13 atom at the distance E shall be represented by a function g(E) of the distance E, the maximal value of the g(E) shall be represented by $g(E_{MAX})$, a second order differential of the g(E) shall be represented by g"(E), a distance of a point at which g" (E) changes from g" (E)=0 to g" (E)<0 when the E is increased toward the surface of electrophotographic photosensitive member, from the boundary portion between the photoconductive layer or photoconductive layer-side portion and the upper charge injection prohibiting portion, shall be represented by $E_A$, and a distance of a point at which g" (E) subsequently changes from g" (E)<0 to g" (E)=0, from the boundary portion between the photoconductive layer or photoconductive layer-side portion and the upper charge injection prohibiting portion, shall be represented by $E_B$. In addition, among the distances E which satisfy $g((E_A+E_B)/2) \geq g(E_{MAX}) \times 0.5$, the first distance when the above-described upper charge injection prohibiting portion is viewed from the boundary portion between the photoconductive layer or photoconductive layer-side portion and the upper charge injection prohibiting portion shall be represented by $E_S$, and the ionic strength g(E) of the Group atom at the distance $E_S$ shall be represented by the standard ionic strength $g(E_S)$.

Next, a precipitous property ΔY is determined by using the standard ionic strength g(E), from the SIMS analysis.

Figure 10:
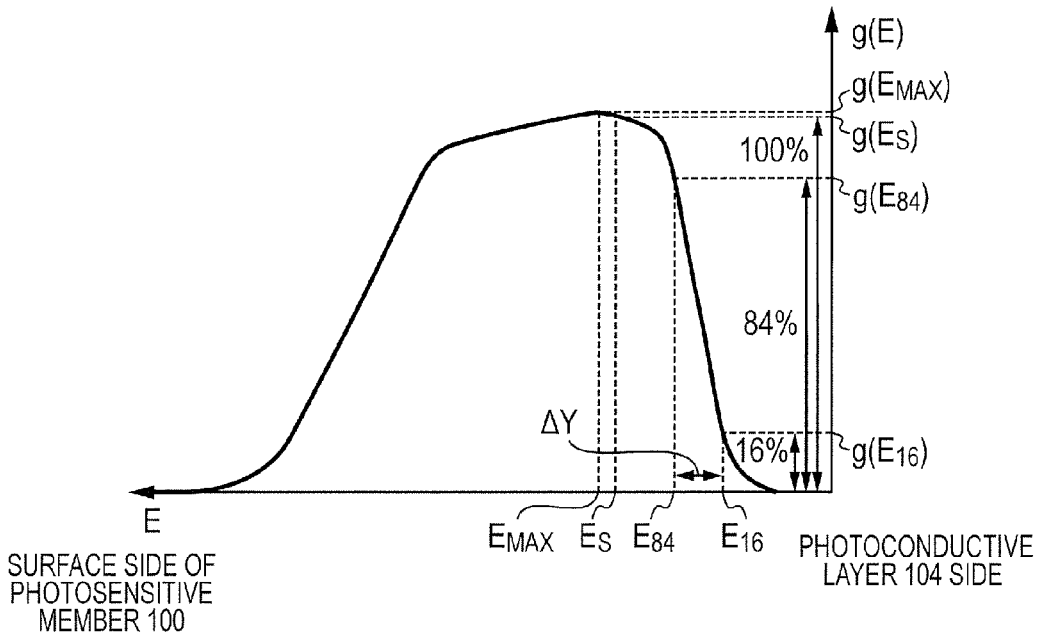
FIG. 10 is a view illustrating an example of the distribution (depth profile) of the ionic strength of the Group 13 atom in the change region, which is obtained by the SIMS analysis.

FIG. 10 is a view illustrating an example of the distribution (depth profile) of the ionic strength of the Group 13 atom in the change region 106, which is obtained by the SIMS analysis. The distribution (depth profile) of the ionic strength of the Group 13 atom and the like in FIG. 10 are the same as the distribution (depth profile) of the ionic strength of the Group 13 atom and the like in FIG. 5, but the symbols are changed for the sake of convenience of description.

In the graph in FIG. 10, a horizontal axis represents a distance E from the boundary portion (boundary) between the photoconductive layer 104 or photoconductive layer-side portion 110 and the upper charge injection prohibiting portion 108. The left side in the horizontal axis is the surface side (surface-side region 107 side) of the photosensitive member 100, and the right side in the horizontal axis is the photoconductive layer 104 side or the photoconductive layer-side portion 110 side. In addition, in the graph in FIG. 10, a vertical axis represents the ionic strength g(E) of the Group 13 atom. The distribution of the ionic strength of the Group 13 atom (depth profile) in FIG. 10 is the same as the distribution of the ionic strength of the Group 13 atom (depth profile) in the upper stage of FIG. 9.

In FIG. 10, $g(E_{MAX})$ is the maximal value of the ionic strength g(E) of the Group 13 atom, as has been described above. $E_{MAX}$ is a distance of a position at which the ionic strength of the Group 13 atom becomes $g(E_{MAX})$, from the boundary portion between the photoconductive layer 104 or photoconductive layer-side portion 110 and the upper charge injection prohibiting portion 108.

In addition, in FIG. 10, $g(E_{84})$ is 84% of the ionic strength when the standard ionic strength $g(E_S)$ is determined to be 100%. In other words, $g(E_{84})=g(E_S)\times 0.84$ holds. $E_{84}$ is a distance of a position at which the ionic strength of the Group 13 atom becomes $g(E_{84})$, from the boundary portion between the photoconductive layer 104 or photoconductive layer-side portion 110 and the upper charge injection prohibiting portion 108. In addition, $g(E_{16})$ is the ionic strength corresponding to 16% when the standard ionic strength $g(E_S)$ is determined to be 100%. In other words, $g(E_{16}=g(E_S)\times 0.16$ holds. $E_{16}$ is a distance of a position at which the ionic strength of the Group 13 atom becomes $g(E_{16})$, from the boundary portion between the photoconductive layer 104 or photoconductive layer-side portion 110 and the upper charge injection prohibiting portion 108.

ΔY is an indicator which represents the precipitous property of the distribution of the Group 13 atom in the a-Si photosensitive member to be evaluated, and is a distance in a depth direction (thickness direction), in which the ionic strength g(E) of the Group 13 atom changes from $g(E_{16}$ to $g(E_{84})$, similarly to ΔZ. In other words, $\Delta Y=|E_{84}-E_{16}|$ holds.

On the other hand, a precipitous property $\Delta Y_0$ in the standard laminated film B is determined by the SIMS analysis ((B5) and (B6)).

In the case of the standard laminated film B as well, it is necessary to fix the measurement conditions when the precipitous property ΔY is determined and when the precipitous property $\Delta Y_0$ is determined, in a similar way to the case of the standard laminated film A.

Firstly, as has been described above, the standard laminated film B is produced which has a film (film $B_1$) that has a composition corresponding to the photoconductive layer 104 or the photoconductive layer-side portion 110, and a film (film $B_2$) that has a composition corresponding to the upper charge injection prohibiting portion 108, stacked in this order. The film $B_1$ does not contain the Group 13 atom. The film $B_2$ uniformly contains Group 13 atoms.

When the standard laminated film B is produced, the production method should be minded so that the distribution of the Group 13 atom theoretically becomes precipitous in the boundary portion (boundary) between the film $B_1$ which does not contain the Group 13 atom and the film $B_2$ which contains the Group 13 atom.

Figure 11:
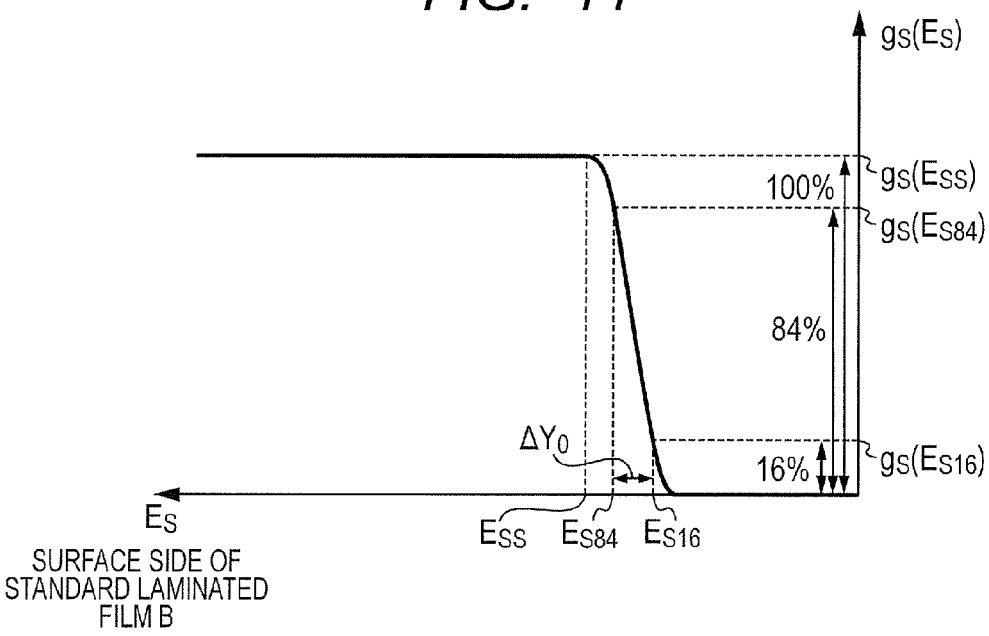
FIG. 11 is a view illustrating an example of the distribution (depth profile) of the ionic strength of the Group 13 atom in a standard laminated film B, which is obtained by the SIMS analysis.

FIG. 11 is a view illustrating an example of the distribution (depth profile) of the ionic strength of the Group 13 atom in the standard laminated film B, which is obtained by the SIMS analysis.

In the graph in FIG. 11, a horizontal axis represents a distance $E_S$ from the rear surface (surface of film $B_1$) of the standard laminated film B. The left side in the horizontal axis is a side of the film $B_2$ which contains the Group 13 atom, and the right side in the horizontal axis is a side of the film $B_1$ which does not contain the Group 13 atom. In addition, in the graph in FIG. 11, a vertical axis represents the ionic strength $g_S(E_S)$ of the Group 13 atom. The standard laminated film B in the example illustrated in FIG. 11 is a standard laminated film B corresponding to the photosensitive member 100 in which the distribution of the ionic strength g(E) of the Group 13 atom in the change region 106 becomes the distribution illustrated in FIG. 9.

The film $B_2$ of the standard laminated film B corresponding to the photosensitive member 100 in which the distribution of the ionic strength g(E) of the Group 13 atom in the change region 106 becomes the distribution illustrated in FIG. 9 contains the Group 13 atom so that the standard ionic strength $g_S(E_{SS})$ becomes equal to the standard ionic strength $g(E_S)$. In other words, $(E_S)=g_S(E_{SS})$ holds.

Other conditions are similar to those in the above-described FIG. 9, and $g_S(E_{S84})$ in FIG. 11 is an ionic strength which becomes 84% when the standard ionic strength $g_S(E_{SS})$ is determined to be 100%. In other words, $g_S(E_{S84})=g_S(E_{SS})\times 0.84$ holds. The $E_{S84}$ is a distance between a position at which the ionic strength of the Group 13 atom becomes the $g_S(E_{S84})$ and the surface of the standard laminated film B. In addition, $g_S(E_{S16})$ is an ionic strength which becomes 16% when the standard ionic strength $g_S(E_{SS})$ is determined to be 100%. In other words, $g_S(E_{S16})=g_S(E_{SS})\times 0.16$ holds. The $E_{S16}$ is a distance between a position at which the ionic strength of the Group 13 atom becomes the $g_S(E_{S16})$ and the surface of the standard laminated film B.

The $\Delta Y_0$ is an indicator which represents the precipitous property of the distribution of the Group 13 atom in the standard laminated film B, and is a distance in a depth direction (thickness direction), in which the ionic strength $g_S(E_S)$ of the Group 13 atom changes from $g(E_{S16})$ to $g(E_{S84})$. In other words, $\Delta Y_0=|E_{S84}-E_{S16}|$ holds.

In addition, the ionic strength which becomes 50% when the $g(E_S)$ in the a-Si photosensitive member to be evaluated is determined to be 100% shall be represented by $g(E_{50})$ (not-shown). In addition, a distance between a position at which the ionic strength of the Group 13 atom becomes $g(E_{50})$ and the surface of the photosensitive member 100 shall be represented by $E_{50}$ (not-shown).

As has been described above, the film $B_2$ of the standard laminated film B is a film which has a composition corresponding to the upper charge injection prohibiting portion in the change region of the a-Si photosensitive member to be evaluated.

As has been described above, in order to enhance the charging ability when the a-Si photosensitive member is negatively electrified, it is important to control the precipitous property of the distribution of the Group 13 atom to a specific range (to control the distribution so as to be as precipitous as possible). For this purpose, it is necessary to accurately evaluate the distribution of the Group 13 atom in the boundary portion (boundary) between the photoconductive layer or photoconductive layer-side portion and the upper charge injection prohibiting portion of the photosensitive member. For this purpose, it is considered that the compositions of the film $B_1$ and the film $B_2$ of the standard laminated film B should be equalized to the composition of the photoconductive layer or photoconductive layer-side portion and the composition of the upper charge injection prohibiting portion of the a-Si photosensitive member to be evaluated, respectively, but the compositions of the film $B_1$ and the film $B_2$ of the standard laminated film B will be controlled in the following way, similarly to the case of the standard laminated film A.

Specifically, the film $B_1$ and the film $B_2$ of the standard laminated film B are layers which contain the silicon atom, the carbon atom and the hydrogen atom of the same contents as the contents of the silicon atom, the carbon atom and the hydrogen atom at a position of which distance from the boundary portion (boundary) between the photoconductive layer or photoconductive layer-side portion and the surface layer of the a-Si photosensitive member to be evaluated is $E_{50}$. Furthermore, the film $B_1$ of the standard laminated film B further contains the Group 13 atom so that the standard ionic strength $g_S(E_{SS})$ becomes equal to the standard ionic strength $g(E_S)$.

Thereby, the standard laminated film B becomes suitable for an accurate evaluation of the precipitous property of the distribution of the Group 13 atom in the boundary portion (boundary) between the photoconductive layer or photoconductive layer-side portion and the upper charge injection prohibiting portion of the a-Si photosensitive member, through relative comparison with the measurement result of the SIMS analysis in the a-Si photosensitive member to be evaluated.

Furthermore, as has been described above, the distribution of the Group 13 atom needs to be theoretically precipitous in the boundary portion (boundary) between the film $B_2$ which contains the Group 13 atom and the film $B_1$ which does not contain the Group 13 atom, in the standard laminated film B, and also when the standard laminated film B is produced, the point should be minded, similarly to the case when the standard laminated film A is produced.

Such the standard laminated film B can be produced in a similar way to the above-described method for producing the standard laminated film A.

(Method for Forming Surface Layer 105)

The method for forming the surface layer of the a-Si photosensitive member of the present invention can adopt any method as long as the method can form such a layer as to satisfy the above-described conditions.

The methods for forming the surface layer include, for instance, a plasma CVD method, a vacuum vapor-deposition method, a sputtering method and an ion plating method. Among the above methods, the plasma CVD method can be used from the viewpoint that the material is easily obtained.

When the plasma CVD method is selected as the method for forming the surface layer, the method for forming the surface layer is, for instance, as follows.

A source gas for supplying a silicon atom and a source gas for supplying a carbon atom are introduced into a reaction vessel of which inner part can be decompressed, in a desired gas state, and glow discharge is generated in the reaction vessel. A surface layer formed from a-SiC may be formed on the substrate (conductive substrate) which has been installed in a predetermined position in the reaction vessel, by decomposing the source gases which have been introduced into the reaction vessel.

The source gases for supplying the silicon atom include, for instance, silanes such as monosilane ($SiH_4$) and disilane ($Si_2H_6$). In addition, the source gases for supplying the carbon atom include, for instance, hydrocarbons such as methane ($CH_4$) and acetylene ($C_2H_2$).

In addition, hydrogen ($H_2$) may be used together with the above-described source gases so as to adjust the ratio (H/(Si+C+H)) of the atom number of hydrogen atoms (H) with respect to the sum of the atom number of silicon atoms (Si), the atom number of carbon atoms (C) and the atom number of the hydrogen atoms (H).

Source gases for supplying the Group 13 atom include, for instance, diborane ($B_2H_6$) and boron trifluoride ($BF_3$).

(Method for Forming Photoconductive Layer 104)

The methods for forming the photoconductive layer of the a-Si photosensitive member of the present invention include, for instance, a plasma CVD method, a vacuum vapor-deposition method, a sputtering method and an ion plating method. Among the above methods, the plasma CVD method can be used for the viewpoint that the material is easily obtained.

When the plasma CVD method is selected as the method for forming the photoconductive layer, the method for forming the photoconductive layer is, for instance, as follows.

A source gas for supplying a silicon atom is introduced into a reaction vessel of which inner part can be decompressed, in a desired gas state, and glow discharge is generated in the reaction vessel. A photoconductive layer formed from a-SiC may be formed on the substrate which has been installed in a predetermined position in the reaction vessel, by decomposing the source gas which has been introduced into the reaction vessel.

The source gases for supplying the silicon atom include, for instance, silanes such as monosilane ($SiH_4$) and disilane ($Si_2H_6$).

In addition, hydrogen ($H_2$) may be used together with the above-described source gases so as to adjust the ratio (H/(Si+H)) of the atom number of hydrogen atoms (H) with respect to the sum of the atom number of the silicon atoms (Si) and the atom number of the hydrogen atoms (H).

In addition, when a halogen atom, an atom for controlling an electrical conduction property, a carbon atom, an oxygen atom, a nitrogen atom and the like are contained in the photoconductive layer 104, a substance which contains each atom and is gaseous or is easily gasified may be appropriately used as a material.

(Method for Manufacturing Electrophotographic Photosensitive Member (a-Si Photosensitive Member) of Present Invention)

Figure 7:
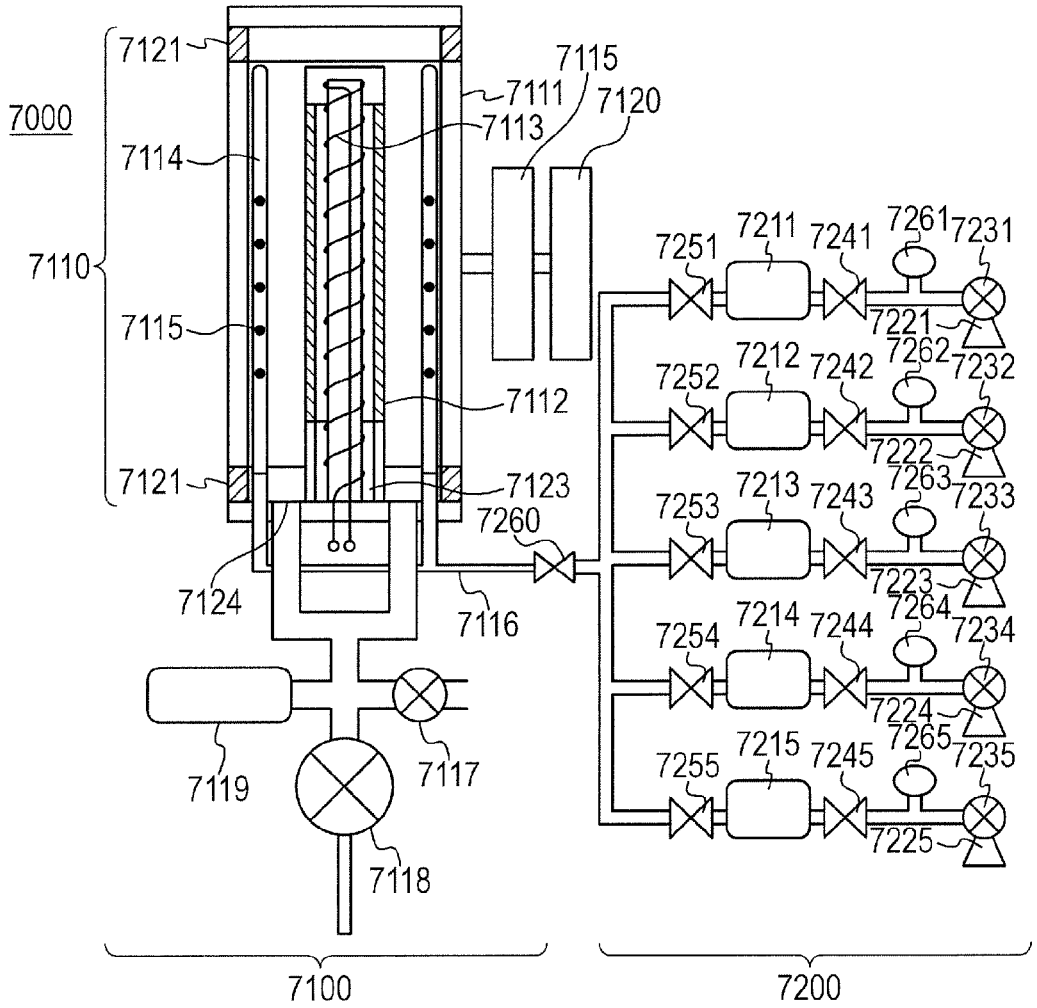
FIG. 7 is a view illustrating an example of an apparatus for forming a deposition film, which can be used in the manufacture of the electrophotographic photosensitive member to be negatively electrified according to the present invention.

FIG. 7 is a view illustrating an example of an apparatus for forming a deposition film, which can be used in the manufacture of the electrophotographic photosensitive member (a-Si photosensitive member) to be negatively electrified according to the present invention. The apparatus for forming the deposition film illustrated in FIG. 7 is an apparatus for forming a deposition film with an RF plasma CVD method that uses a high-frequency power source.

If the apparatus 7000 for forming the deposition film illustrated in FIG. 7 is roughly divided, the apparatus includes a deposition device 7100 having a reaction vessel 7110 which can be decompressed, a source gas supply device 7200, and an exhaust device (not-shown) for decompressing the inner part of the reaction vessel 7110.

The reaction vessel 7110 in the deposition device 7100 has a substrate 7112 connected to the ground, a heater 7113 for heating the substrate and a source gas introduction pipe 7114, installed therein. In addition, a high-frequency power source 7120 is connected to a cathode 7111 through a high-frequency matching box 7115.

The source gas supply device 7200 is provided with source gas bombs of source gases 7221 to 7225 of $SiH_4$, $H_2$, $CH_4$, NO, $B_2H_6$ and the like.

In addition, the source gas supply device 7200 has valves 7231 to 7235, pressure controllers 7261 to 7265, inflow valves 7241 to 7245, outflow valves 7251 to 7255 and mass flow controllers 7211 to 7215.

Bombs having the respective source gases sealed therein are connected to the source gas introduction pipe 7114 in the reaction vessel 7110 through an auxiliary valve 7260.

Next, a method for forming a deposition film with the use of the apparatus 7000 for forming the deposition film will be described below.

Firstly, a substrate 7112 which has been previously degreased and cleaned is installed on a cradle 7123 in the reaction vessel 7110. Subsequently, an exhaust device (not-shown) is operated, and the inside of the reaction vessel 7110 is exhausted. When the pressure in the reaction vessel 7110 has reached a predetermined pressure (for instance, 1 Pa or lower), an operator shall supply an electric power to a heater 7113 for heating the substrate to heat the substrate 7112 to a predetermined temperature (for instance, 50 to 350° C.), while watching a display of a vacuum gage 7119. At this time, by supplying an inert gas such as Ar and He from the gas supply device 7200 into the reaction vessel 7110, the substrate 7112 can be heated also in the inert gas atmosphere.

Subsequently, a source gas to be used for forming the deposition film is supplied from the gas supply device 7200 into the reaction vessel 7110. Specifically, the valves 7231 to 7235, the inflow valves 7241 to 7245 and the outflow valves 7251 to 7255 are opened as needed, and the flow rates of the mass flow controllers 7211 to 7215 are set. When the flow rate of each of the mass flow controllers becomes stable, an operator shall operate a main valve 7118 to adjust the pressure in the reaction vessel 7110 to a predetermined pressure, while watching the display of the vacuum gage 7119. When the predetermined pressure has been obtained, an operator shall introduce the high-frequency power into the reaction vessel 7110 from the high-frequency power source 7120, and simultaneously shall operate the high-frequency matching box 7115 to generate plasma discharge in the reaction vessel 7110. Thereby, the source gas which has been supplied into the reaction vessel 7110 is excited. After that, the high-frequency power is promptly adjusted to a predetermined power, and a deposition film is formed.

When the formation of a predetermined deposition film has been finished, the introduction of the high-frequency power into the reaction vessel 7110 is stopped, the valves 7231 to 7235, the inflow valves 7241 to 7245, the outflow valves 7251 to 7255 and the auxiliary valve 7260 are closed, and the supply of the source gas into the reaction vessel 7110 is finished. At the same time, the main valve 7118 is fully opened to exhaust the inside of the reaction vessel 7110 until the pressure in the reaction vessel 7110 reaches a predetermined pressure (for instance, 1 Pa or lower).

By the above-described procedures, the formation of the deposition film is finished, but when a plurality of deposition films are formed, the respective layers may be formed by repeating the above-described procedures again. The joining regions between the respective layers can also be formed by changing the flow rate of the source gas and the pressure in the reaction vessel and the like.

After the formation of all deposition films has been finished, the main valve 7118 is closed, an inert gas is introduced into the reaction vessel 7110 to return the pressure in the reaction vessel 7110 to atmospheric pressure, and the substrate 7112 is taken out from the reaction vessel 7110.

(Electrophotographic Apparatus)

Next, an electrophotographic apparatus having an electrophotographic photosensitive member (a-Si photosensitive member) of the present invention will be described below.

Figure 8:
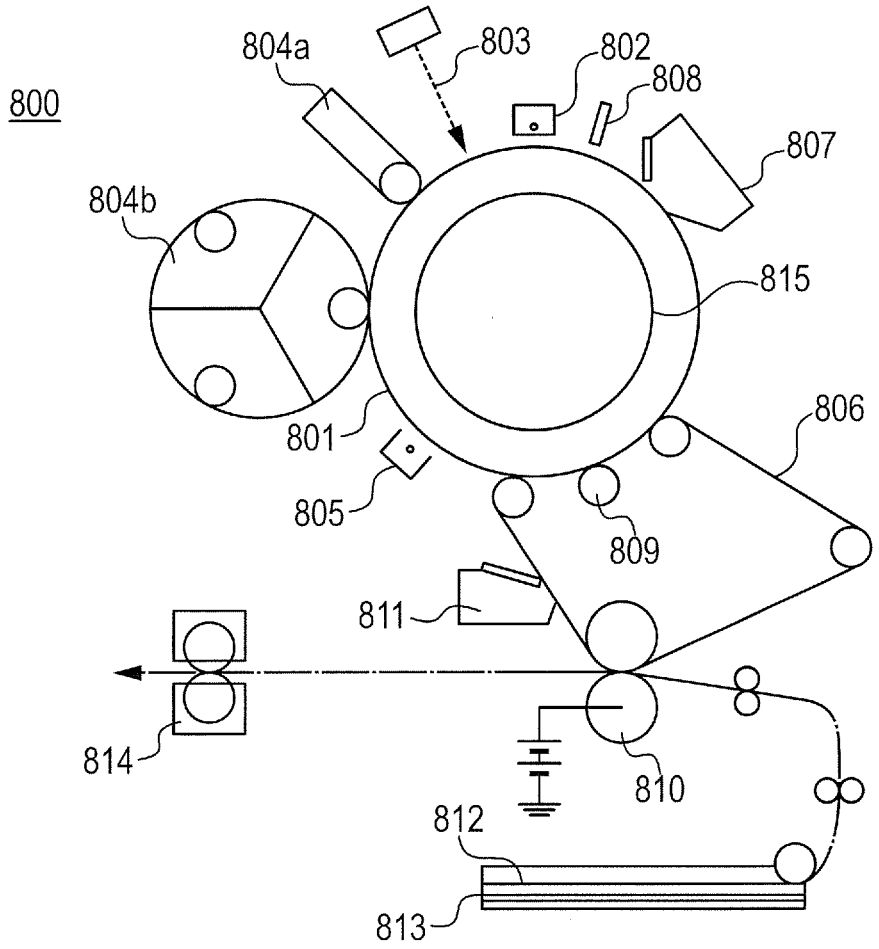
FIG. 8 is a view illustrating an example of an electrophotographic apparatus having the electrophotographic photosensitive member to be negatively electrified therein according to the present invention.

FIG. 8 is a view illustrating an example of an electrophotographic apparatus having the electrophotographic photosensitive member (a-Si photosensitive member) to be negatively electrified therein according to the present invention.

The electrophotographic apparatus 800 illustrated in FIG. 8 has a cylindrical electrophotographic photosensitive member (photosensitive member) 801. A charging device (primary charging device) 802 which negatively electrifies the surface of the photosensitive member 801 is arranged around the photosensitive member 801.

In addition, an image exposure device (not-shown) is arranged therein which irradiates the surface of the charged photosensitive member 801 with image-exposing light 803 to form an electrostatic latent image on the surface of the photosensitive member 801.

In addition, a first developing device 804*a* having a black toner and a second developing device 804*b* having a color toner are arranged as a developing apparatus for developing an electrostatic latent image formed on the surface of the photosensitive member 801 to form a toner image on the surface of the photosensitive member 801. The second developing device 804*b* is a rotation type of the developing apparatus which has a developing device for yellow having a yellow toner, a developing device for magenta having a magenta toner and a developing device for cyan having a cyan toner, built therein.

The developing apparatus of the electrophotographic apparatus 800 includes the first developing device 804*a* and the second developing device 804*b*.

In addition, a pre-transfer charging device 805 is arranged in the electrophotographic apparatus 800 so as to uniformize electric charges of toners that constitute the toner image formed on the surface of the photosensitive member 801 and stably transfer the toner image.

In addition, a cleaning blade 807 for the photosensitive member is arranged therein so as to clean the surface of the photosensitive member 801 after the toner image has been transferred onto the surface of an intermediate transfer belt 806 from the surface of the photosensitive member 801.

In addition, a pre-exposure device 808 is arranged therein so as to diselectrify the surface of the photosensitive member 801 by irradiating the surface of the photosensitive member 801 with pre-exposure light.

The intermediate transfer belt 806 is arranged so as to form an abutting nipping portion on the photosensitive member 801, and can be rotationally driven.

A primary transfer roller 809 is arranged in the inside of the intermediate transfer belt 806 so as to transfer (primarily transfer) the toner image on the surface of the photosensitive member 801, onto the surface of the intermediate transfer belt 806.

A bias power source (not-shown) is connected to the primary transfer roller 809, which applies a primary transfer bias for transferring the toner image on the surface of the photosensitive member 801 onto the surface of the intermediate transfer belt 806, to the primary transfer roller 809.

In addition, a secondary transfer roller 810 for transferring (secondarily transferring) the toner image on the surface of the intermediate transfer belt 806 onto a transfer material (paper or the like) 812 is arranged around the intermediate transfer belt 806 so as to come in contact with the surface of the intermediate transfer belt 806.

A bias power source (not-shown) is connected to the secondary transfer roller 810, which applies a secondary transfer bias for transferring the toner image on the surface of the intermediate transfer belt 806 onto the transfer material 812, to the secondary transfer roller 810.

In addition, a cleaning blade 811 for the intermediate transfer belt is arranged so as to clean the surface of the intermediate transfer belt 806 after the toner image has been transferred onto the transfer material 812 from the surface of the intermediate transfer belt 806.

A transfer device of the electrophotographic apparatus 800 includes the intermediate transfer belt 806, the primarily transfer roller 809 and the secondary transfer roller 810.

In addition, the electrophotographic apparatus 800 includes a sheet-feeding cassette 813 for holding a plurality of the transfer materials 812 therein on which images are formed, and a transport mechanism for transporting the transfer material 812 from the sheet-feeding cassette 813 to the abutting nipping portion at which the intermediate transfer belt 806 abuts on the secondary transfer roller 810. A fixing device 814 is arranged on the transport path of the transfer material 812 so as to fix the toner image transferred onto the transfer material 812 on the transfer material 812.

In addition, a heater 815 is arranged in the inner part of the photosensitive member 801, and heats the photosensitive member 801 to a predetermined temperature (for instance, 40 to 45° C.).

For instance, a color separation and imaging exposure optical system for a color image, a scanning exposure optical system including a laser scanner for outputting a laser beam which is modulated so as to correspond to a time-series electric digital pixel signal of image information and the like are used as the image exposure device (not-shown). Such an optical system can form an electrostatic latent image on the surface of the photosensitive member 801 according to an image pattern, by irradiating the surface of the photosensitive member 801 with image-exposing light (beam) emitted from a light source (for instance, laser and LED) for every pixel in a pixel matrix having a plurality of lines and rows.

Next, an operation of this electrophotographic apparatus will be described below.

Firstly, the photosensitive member 801 is rotationally driven in a counterclockwise direction at a predetermined peripheral velocity (process speed), and the intermediate transfer belt 806 is rotationally driven in a clockwise direction at the same peripheral velocity as that of the photosensitive member 801.

The surface of the photosensitive member 801 is negatively electrified in the rotation process by the charging device (primary charging device) 802.

Subsequently, the surface of the photosensitive member 801 is irradiated with the image-exposing light 803 to form an electrostatic latent image which corresponds to a first color component image (for instance, magenta component image) of a target color image, on the surface of the photosensitive member 801.

Subsequently, when the first color component image is, for instance, the magenta component image, the second developing device 804*b* rotates, the developing device for magenta is set at a predetermined position, an electrostatic latent image corresponding to the magenta component image is developed with a magenta toner, and a magenta toner image is formed on the surface of the photosensitive member 801. At this time, the first developing device 804*a* is turned off, does not act on the photosensitive member 801, and does not give influence on the magenta toner image.

A primary transfer bias is applied to the primary transfer roller 809 from the bias power source (not-shown), and an electric field is formed between the photosensitive member 801 and the intermediate transfer belt 805. The magenta toner image formed on the surface of photosensitive member 801 is transferred (primarily transferred) onto the surface (outer peripheral face) of the intermediate transfer belt 806, in a process of passing through the abutting nipping portion at which the photosensitive member 801 abuts on the intermediate transfer belt 806, by an action of this electric field.

The surface of the photosensitive member 801 which has finished the transfer of the magenta toner image onto the surface of the intermediate transfer belt 806 is cleaned by the cleaning blade 807 for the photosensitive member.

Subsequently, a toner image of a second color (for instance, toner image of cyan) is formed on the surface of the photosensitive member 801 in a similar way to that in the formation of a toner image of a first color (toner image of magenta), and the toner image of the second color (toner image of cyan) is superposed and transferred (primarily transferred) onto the surface of the intermediate transfer belt 806, onto which the toner image of the first color (toner image of magenta) has been transferred.

The surface of the photosensitive member 801 which has finished the transfer of the toner image of the second color (toner image of cyan) onto the surface of the intermediate transfer belt 806 is cleaned by the cleaning blade 807 for the photosensitive member.

Subsequently, a toner image of a third color (for instance, toner image of yellow) is formed on the surface of the photosensitive member 801 in a similar way to that in the formation of the toner image of the first color (toner image of magenta), and the toner image of the third color (toner image of yellow) is superposed and transferred (primarily transferred) onto the surface of the intermediate transfer belt 806, onto which the toner image of the first color (toner image of magenta) has been transferred.

The surface of the photosensitive member 801 which has finished the transfer of the toner image of the third color (toner image of yellow) onto the surface of the intermediate transfer belt 806 is cleaned by the cleaning blade 807 for the photosensitive member.

Subsequently, a toner image of a fourth color (for instance, toner image of black) is formed on the surface of the photosensitive member 801 in a similar way to that in the formation of the toner image of the first color (toner image of magenta), and the toner image of the fourth color (toner image of black) is superposed and transferred (primarily transferred) onto the surface of the intermediate transfer belt 806, onto which the toner image of the first color (toner image of magenta) has been transferred.

When the black toner image is formed, the first developing device 804*a* having the black toner is turned on in place of the second developing device 804*b*, as the developing apparatus. At this time, the second developing device 804*b* is turned off, and does not act on the photosensitive member 801.

The surface of the photosensitive member 801 which has finished the transfer of the toner image of the fourth color (toner image of black) onto the surface of the intermediate transfer belt 806 is cleaned by the cleaning blade 807 for the photosensitive member.

Thus, the toner images of the first color to the fourth color are sequentially superposed and transferred (primarily transferred) onto the surface of the transfer belt 806, and a composite color toner image corresponding to the target color image is formed on the surface of the transfer belt 806.

Next, the secondary transfer roller 810 is abutted on the intermediate transfer belt 806, and the transfer material 812 is also fed to the abutting nipping portion at which the intermediate transfer belt 806 abuts on the secondary transfer roller 810 from the sheet-feeding cassette 813 at predetermined timing.

The secondary transfer bias is applied to the secondary transfer roller 810 from the bias power source (not-shown), and the composite color toner image formed on the surface of the intermediate transfer belt 806 is transferred (secondarily transferred) onto the transfer material 812.

The surface of the intermediate transfer belt 806 which has finished the transfer of the composite color toner image onto the transfer material 812 is cleaned by the cleaning blade 811 for the intermediate transfer belt.

The transfer material 812 onto which the composite color toner image has been transferred is led to the fixing device 814, and the toner image is fixed on the transfer material 812 there.

The present invention will be described further in detail below with reference to examples. Incidentally, in any example, $SiH_4$, $CH_4$, $B_2H_6$ and $H_2$ are gaseous which are introduced into the reaction vessel.

Example 1

Layers illustrated in FIG. 1A and FIG. 1B were formed on the conductive substrates (substrates) 7112 which were made from aluminum and had a cylindrical shape with a diameter of 84 mm, a length of 381 mm and a thickness of 3 mm, with the use of the apparatus 7000 for forming a deposition film as illustrated in FIG. 7, on conditions shown in Table 1, and a cylindrical electrophotographic photosensitive member to be negatively electrified (a-Si photosensitive member) was manufactured.

The change region 106 was formed in the following way.

As shown in Table 1, a flow rate of $SiH_4$ which was introduced into the reaction vessel 7110 was continuously changed from 100 [mL/min (normal)] to 90 [mL/min (normal), from 90 [mL/min (normal) to 75 [mL/min (normal)], and from 75 [mL/min (normal)] to 15 [mL/min (normal)].

At the same time, a flow rate of $CH_4$ which was introduced into the reaction vessel 7110 was continuously changed from 25 [mL/min (normal)] to 55 [mL/min (normal), from 55 [mL/min (normal) to 75 [mL/min (normal)], and from 75 [mL/min (normal)] to 360 [mL/min (normal)].

In the above way, the change region 106 was formed in which the above-described ratio (C/(Si+C)) linearly changed as is illustrated in FIG. 2A.

The above-described ratio (C/(Si+C)) in the photoconductive layer 104 side of the change region 106 was 0.00, and the above-described ratio (C/(Si+C)) in the surface-side region 107 side was 0.60.

The upper charge injection prohibiting portion 108 in the change region 106 was formed in the following way.

In the conditions on which the change region 106 was formed, at the time when a flow rate of $SiH_4$ which was introduced into the reaction vessel 7110 became 90 [mL/min (normal)] and when a flow rate of $CH_4$ became 55 [mL/min (normal)], $B_2H_6$ was introduced into the reaction vessel 7110 for 60 seconds, and the introduction amount (flow rate) was increased from 0 ppm to 200 ppm with respect to $SiH_4$. After that, a deposition film was formed while the flow rate of $B_2H_6$ was maintained at 200 ppm with respect to $SiH_4$.

After that, in the conditions on which the change region 106 was formed, at the time when the flow rate of $SiH_4$ which was introduced into the reaction vessel 7110 became 75 [mL/min (normal)] and when the flow rate of $CH_4$ became 75 [mL/min (normal)], the high-frequency power source 7120 was immediately turned OFF, and the high-frequency power which was introduced into the reaction vessel 7110 was stopped.

After that, the introduction of all the source gases into the reaction vessel 7110 was stopped, and the gases in the reaction vessel 7110 were purged by Ar five times.

After that, the flow rate of $SiH_4$ which was introduced into the reaction vessel 7110 was set at 75 [mL/min (normal)], the flow rate of $CH_4$ was set at 75 [mL/min (normal)], and the introduction of $SiH_4$ and $CH_4$ into the reaction vessel 7110 was restarted. When the flow rates of $SiH_4$ and $CH_4$ and the internal pressure (pressure in the reaction vessel 7110) became stable, the introduction of the high-frequency power into the reaction vessel 7110 was restarted, and the formation of the change region 106 was started again.

The manufactured a-Si photosensitive member was installed in an electrophotographic apparatus for evaluation (such remodeled machine that copying machine (trade name: iRC6800) made by Canon Inc. was remodeled into a negative electrification type), and was subjected to the evaluations of "charging ability," "luminous sensitivity" and "precipitous property," in the following way. Incidentally, a process speed of the electrophotographic apparatus for the evaluation was set at 265 mm/sec. In addition, the quantity of light of the pre-exposure light (light with a wavelength of 660 nm emitted from an LED) was set at 4 $\mu J/cm^2$.

"Charging Ability"

The current value of a charging device (primary charging device) of the electrophotographic apparatus for the evaluation was set at 1000 μA, and the a-Si photosensitive member was charged. A dark part potential of the surface of the a-Si photosensitive member after having been charged was measured with a surface potential meter (made by TREK, Inc., trade name: Model 555P-4). The measurement position of the dark part potential was determined to be a middle position in an axial direction of the a-Si photosensitive member, and the dark part potential was determined to be an average value in a circumferential direction. This dark part potential was determined to be the charging ability.

"Luminous Sensitivity"

The a-Si photosensitive member was charged by adjusting the current value of the charging device (primary charging device) so that a potential of the middle position in the axial direction of the surface of the a-Si photosensitive member became −450 V (dark part potential) when having been measured with the surface potential meter (made by TREK, Inc., trade name: Model 555P-4). After the a-Si photosensitive member was charged, the whole face of the surface of the a-Si photosensitive member was irradiated with image-exposing light (light with a wavelength of 655 nm from the laser). At this time, the quantity of light of the laser was adjusted so that the potential at the middle position in the axial direction of the surface of the a-Si photosensitive member was set at −50 V (bright part potential) when having been measured with the above-described surface potential meter. The measurement position of the bright part potential was determined to be the middle position in the axial direction of the cylindrical a-Si photosensitive member, and the bright part potential was determined to be an average value in the circumferential direction. The quantity of light of the laser which was emitted at this time was determined to be the luminous sensitivity.

"Precipitous Property"

The middle position in the axial direction of the surface of the manufactured a-Si photosensitive member was subjected to the SIMS analysis. The SIMS analysis was conducted for the upper charge injection prohibiting portion 108 and the change region 106 including the upper charge injection prohibiting portion 108. IMS-4F (trade name) made by CAMECA SAS was used for the SIMS analysis, and the SIMS analysis was conducted on measurement conditions shown in Table 2. $f(D_S)$ and $\Delta Z$ were determined from the depth profile of the ionic strength of the Group 13 atom, which was obtained by the SIMS analysis.

Furthermore, compositions of the hydrogen atom, the carbon atom and the silicon atom were determined at the position at which the ionic strength of the Group 13 atom became $f(D_{50})$, and as a result, the compositions were as follows: hydrogen atom=32.2 atom %, carbon atom=11.4 atom %, and silicon atom=56.3 atom %.

Subsequently, a standard laminated film A (film $A_1$ and film $A_2$) was produced on the surface of the conductive substrate (substrate) 7112 which was made from aluminum and had a cylindrical shape with a diameter of 84 mm, a length of 381 mm and a wall thickness of 3 mm, with the use of the apparatus 7000 for forming a deposition film illustrated in FIG. 7, on conditions shown in Table 3, in a similar way to that in the manufacture of the a-Si photosensitive member.

Specifically, after the film $A_1$ was formed, the high-frequency power source 7120 was immediately turned OFF, and the high-frequency power which was introduced into the reaction vessel 7110 was stopped.

After that, the introduction of all the source gases into the reaction vessel 7110 was stopped, and the gases in the reaction vessel 7110 were purged by Ar five times.

After that, source gases for forming the film $A_2$ were introduced into the reaction vessel 7110, as is shown in Table 3. When the flow rates of the source gases and the internal pressure (pressure in the reaction vessel 7110) became stable, the high-frequency power was introduced into the reaction vessel 7110, and the film $A_2$ was formed on the film $A_1$.

The produced standard laminated film A was subjected to the SIMS analysis on similar conditions to those in the case of the above-described a-Si photosensitive member.

The compositions of the hydrogen atom, the carbon atom and the silicon atom were determined in the standard laminated film A, and as a result, the compositions of the standard laminated film A (film $A_1$ and film $A_2$) were as follows: hydrogen atom=33.2 atom %, carbon atom=12.4 atom %, and silicon atom=54.3 atom %. In other words, the compositions were equal to those of the hydrogen atom, the carbon atom and the silicon atom at the position at which the ionic strength of the Group 13 atom became $f(D_{50})$ on the above-described a-Si photosensitive member.

Then, $f_S(D_{SS})$ and $\Delta Z_0$ were determined from the depth profile of the ionic strength of the Group 13 atom, which was obtained by the SIMS analysis.

As a result, the ratio was $\Delta Z/\Delta Z_0=1.0$.

The obtained result is shown in Table 4. Incidentally, in any example, both "charging ability" and "luminous sensitivity" were evaluated by a relative evaluation in which the result of Comparative Example 1 was regarded as 100.

Example 2

An a-Si photosensitive member was manufactured with similar procedures to those in Example 1, except that conditions shown in Table 1 were changed to conditions shown in Table 5.

However, in the present example, the upper charge injection prohibiting portion 108 was formed in the following way.

In the conditions on which the change region 106 was formed, at the time when a flow rate of $SiH_4$ which was introduced into the reaction vessel 7110 became 90 [mL/min (normal)] and when a flow rate of $CH_4$ became 55 [mL/min (normal)], $B_2H_6$ was introduced into the reaction vessel 7110 for 60 seconds, and the introduction amount (flow rate) was increased from 0 ppm to 200 ppm with respect to $SiH_4$. After that, a deposition film was formed while a flow rate of $B_2H_6$ was maintained at 200 ppm with respect to $SiH_4$. After that, in the conditions on which the change region 106 was formed, at the time when the flow rate of $SiH_4$ which was introduced into the reaction vessel 7110 became 75 [mL/min (normal)] and when the flow rate of $CH_4$ became 75 [mL/min (normal)], the inflow valve 7245 and the outflow valve 7255 of $B_2H_6$ were immediately closed, and the introduction of $B_2H_6$ into the reaction vessel 7110 was stopped.

After that, the change region 106 was formed in succession.

The manufactured a-Si photosensitive member was subjected to the evaluations of "charging ability" and "luminous sensitivity" in a similar way to those in Example 1. In addition, "precipitous property" was evaluated in the following way.

"Precipitous Property"

The middle position in an axial direction on the surface of the manufactured a-Si photosensitive member was subjected to the SIMS analysis in a similar way to that in Example 1. $f(D_S)$ and $\Delta Z$ were determined from a depth profile of the ionic strength of a Group 13 atom, which was obtained by the SIMS analysis.

Furthermore, compositions of the hydrogen atom, the carbon atom and the silicon atom were determined at the position at which the ionic strength of the Group 13 atom became $f(D_{50})$, and as a result, the compositions were as follows: hydrogen atom=32.2 atom %, carbon atom=11.9 atom %, and silicon atom=55.9 atom %.

Next, the standard laminated film A (film $A_1$ and film $A_2$) was produced in a similar way to that used when the a-Si photosensitive member of the present example was manufactured, in imitation of procedures of Example 1, and was subjected to the SIMS analysis on similar conditions to those in the case of the a-Si photosensitive member.

Then, $f_S(D_{SS})$ and $\Delta Z_0$ were determined from the depth profile of the ionic strength of the Group 13 atom, which was obtained by the SIMS analysis.

As a result, the ratio was $\Delta Z/\Delta Z_0=3.0$.

The obtained result is shown in Table 4.

Example 3

An a-Si photosensitive member was manufactured with similar procedures to those in Example 1, except that conditions shown in Table 1 were changed to conditions shown in Table 6.

However, in the present example, the upper charge injection prohibiting portion 108 was formed in the following way.

In the conditions on which the change region 106 was formed, at the time when a flow rate of $SiH_4$ which was introduced into the reaction vessel 7110 became 90 [mL/min (normal)] and when a flow rate of $CH_4$ became 55 [mL/min (normal)], $B_2H_6$ was introduced into the reaction vessel 7110 for 60 seconds, and the introduction amount (flow rate) was increased from 0 ppm to 200 ppm with respect to $SiH_4$. After that, a deposition film was formed while a flow rate of $B_2H_6$ was maintained at 200 ppm with respect to $SiH_4$. After that, in the conditions on which the change region 106 was formed, at the time when the flow rate of $SiH_4$ which was introduced into the reaction vessel 7110 became 75 [mL/min (normal)] and when the flow rate of $CH_4$ became 75 [mL/min (normal)], the inflow valve 7245 and the outflow valve 7255 of $B_2H_6$ were immediately closed, and the introduction of $B_2H_6$ into the reaction vessel 7110 was stopped.

At the same time when the introduction of $B_2H_6$ into the reaction vessel 7110 was stopped, $H_2$ was introduced into the reaction vessel 7110 at a flow rate equal to that of $B_2H_6$.

After that, the change region 106 was formed in succession.

The manufactured a-Si photosensitive member was subjected to the evaluations of "charging ability" and "luminous sensitivity" in a similar way to those in Example 1. In addition, "precipitous property" was evaluated in the following way.

"Precipitous Property"

The middle position in an axial direction on the surface of the manufactured a-Si photosensitive member was subjected to the SIMS analysis in a similar way to that in Example 1.

$f(D_S)$ and $\Delta Z$ were determined from a depth profile of the ionic strength of a Group 13 atom, which was obtained by the SIMS analysis.

Furthermore, compositions of the hydrogen atom, the carbon atom and the silicon atom were determined at the position at which the ionic strength of the Group 13 atom became $f(D_{50})$, and as a result, the compositions were as follows: hydrogen atom=33.2 atom %, carbon atom=11.4 atom %, and silicon atom=56.3 atom %.

Next, the standard laminated film A (film $A_1$ and film $A_2$) was produced in a similar way to that used when the a-Si photosensitive member of the present example was manufactured, in imitation of procedures of Example 1, and was subjected to the SIMS analysis on similar conditions to those in the case of the a-Si photosensitive member.

Then, $f_S(D_S)$ and $\Delta Z_0$ were determined from the depth profile of the ionic strength of the Group 13 atom, which was obtained by the SIMS analysis.

As a result, the ratio was $\Delta Z/\Delta Z_0=1.6$.

The obtained result is shown in Table 4.

Comparative Example 1

An a-Si photosensitive member was manufactured with similar procedures to those in Example 1, except that conditions shown in Table 1 were changed to conditions shown in Table 7.

However, in the present comparative example, the upper charge injection prohibiting portion 108 was formed in the following way.

In the conditions on which the change region 106 was formed, at the time when a flow rate of $SiH_4$ which was introduced into the reaction vessel 7110 became 90 [mL/min (normal)] and when a flow rate of $CH_4$ became 55 [mL/min (normal)], $B_2H_6$ was introduced into the reaction vessel 7110 for 60 seconds, and the introduction amount (flow rate) was increased from 0 ppm to 200 ppm with respect to $SiH_4$. Then, a deposition film was formed while a flow rate of $B_2H_6$ was maintained at 200 ppm with respect to $SiH_4$. After that, in the conditions on which the change region 106 was formed, at the time when the flow rate of $SiH_4$ which was introduced into the reaction vessel 7110 became 75 [mL/min (normal)] and when the flow rate of $CH_4$ became 75 [mL/min (normal)], the flow rate of $B_2H_6$ was linearly decreased for 10 seconds, and the introduction of $B_2H_6$ into the reaction vessel 7110 was stopped.

After that, the change region 106 was formed in succession.

The manufactured a-Si photosensitive member was subjected to the evaluations of "charging ability" and "luminous sensitivity" in a similar way to those in Example 1. In addition, "precipitous property" was evaluated in the following way.

"Precipitous Property"

The middle position in an axial direction on the surface of the manufactured a-Si photosensitive member was subjected to the SIMS analysis in a similar way to that in Example 1. $f(D_S)$ and $\Delta Z$ were determined from a depth profile of the ionic strength of a Group 13 atom, which was obtained by the SIMS analysis.

Furthermore, compositions of the hydrogen atom, the carbon atom and the silicon atom were determined at the position at which the ionic strength of the Group 13 atom became $f(D_{50})$, and as a result, the compositions were as follows: hydrogen atom=35.0 atom %, carbon atom=12.9 atom %, and silicon atom=52.3 atom %.

Next, the standard laminated film A (film $A_1$ and film $A_2$) was produced in a similar way to that used when the a-Si photosensitive member of the present comparative example was manufactured, in imitation of procedures of Example 1, and was subjected to the SIMS analysis on similar conditions to those in the case of the a-Si photosensitive member.

Then, $f_S(D_S)$ and $\Delta Z_0$ were determined from the depth profile of the ionic strength of the Group 13 atom, which was obtained by the SIMS analysis.

As a result, the ratio was $\Delta Z/\Delta Z_0=5.1$.

The obtained result is shown in Table 4.

Incidentally, a dark part potential concerned with the charging ability of Comparative Example 1 was −425 V, and the quantity of light of the laser concerned with the luminous sensitivity was 0.45 $\mu J/cm^2$.

Comparative Example 2

An a-Si photosensitive member was manufactured with similar procedures to those in Example 1, except that conditions shown in Table 1 were changed to conditions which were adopted in Example 1 described in Japanese Patent Application Laid-Open No. 2002-236379. However, the used substrate was not a substrate which was adopted in Example 1 described in Publication No. 2002-236379, but was a substrate which was similar to Example 1 in the present application.

The manufactured a-Si photosensitive member was subjected to the evaluations of "charging ability" and "luminous sensitivity" in a similar way to those in Example 1. In addition, "precipitous property" was evaluated in the following way.

"Precipitous Property"

The middle position in an axial direction on the surface of the manufactured a-Si photosensitive member was subjected to the SIMS analysis in a similar way to that in Example 1. $f(D_S)$ and $\Delta Z$ were determined from a depth profile of the ionic strength of Group 13 atom, which was obtained by the SIMS analysis.

Furthermore, compositions of the hydrogen atom, the carbon atom and the silicon atom were determined at the position at which the ionic strength of the Group 13 atom became $f(D_{50})$, and as a result, the compositions were as follows: hydrogen atom=40.7 atom %, carbon atom=17.6 atom %, and silicon atom=41.6 atom %.

Next, the standard laminated film A (film $A_1$ and film $A_2$) was produced in a similar way to that used when the a-Si photosensitive member of the present comparative example was manufactured, in imitation of procedures of Example 1, and was subjected to the SIMS analysis on similar conditions to those in the case of the a-Si photosensitive member. Incidentally, the film $A_1$ was made to contain the boron atom of 3500 ppm with respect to the silicon atom. $f(D_S)$ and $\Delta Z$ were determined from a depth profile of the ionic strength of a Group 13 atom, which was obtained by the SIMS analysis.

Compositions of the hydrogen atom, the carbon atom and the silicon atom were determined in the standard laminated film A, and as a result, the compositions of the standard laminated film A (film $A_1$ and film $A_2$) were as follows: hydrogen atom=41.0 atom %, carbon atom=15.6 atom %, and silicon atom=43.3 atom %. In other words, the compositions were equal to those of the hydrogen atom, the carbon atom and the silicon atom at the position at which the ionic strength of the Group 13 atom became $f(D_{50})$ on the above-described a-Si photosensitive member.

Then, $f_S(D_S)$ and $\Delta Z_0$ were determined from the depth profile of the ionic strength of the Group 13 atom, which was obtained by the SIMS analysis.

As a result, the ratio was $\Delta Z/\Delta Z_0=8.5$.

The obtained result is shown in Table 4.

TABLE 1

| | | | Surface layer | | | | |
|---|---|---|---|---|---|---|---|
| | | | Change region | | | | |
| | Lower charge injection prohibiting layer | Photoconductive layer | Photoconductive layer-side portion | Upper charge injection prohibiting portion | | Surface-side portion | Surface-side region |
| Gas type and flow rate | | | | | | | |
| $SiH_4$ [mL/min(normal)] | 150 | 195 | 100→90 | 90→75 | Turn high-frequency power source OFF immediately and stop all source gases. Then, purge inside of reaction vessel five times with Ar. | 75→15 | 15 |
| $H_2$ [mL/min(normal)] | 300 | 1000 | 0 | 0 | | 0 | 0 |
| $B_2H_6$ [ppm with respect to $SiH_4$] | 0 | 0 | 0 | 200 | | 0 | 0 |
| $CH_4$ [mL/min(normal)] | 150 | 0 | 0→55 | 55→75 | | 75→350 | 350 |
| NO [mL/min(normal)] | 10 | 0 | 0 | 0 | | 0 | 0 |
| High-frequency power [mW/cm$^3$] | 10 | 17 | 10 | 10 | 0 | 10 | 10 |
| Temperature of substrate [° C.] | 250 | 270 | 250 | | | | 250 |
| Pressure in reaction vessel [Pa] | 40 | 60 | 25 | | | | 25 |
| Layer thickness [μm] | 3 | 25 | 0.7 | | | | 0.5 |

TABLE 2

| Member to be measured | C/Si composition ratio | H/Si composition ratio | B |
|---|---|---|---|
| Primary ion species | $Cs^+$ | $Cs^+$ | $O_2^+$ |
| Secondary ion species | Positive | Negative | Positive |
| Primary ion energy | 5.5 [keV] | 14.5 [keV] | 8.0 [keV] |
| Amount of electric current due to primary ion | 35 [nA] | 35 [nA] | 200 [nA] |
| Raster area | 200 [μm□] | 150 [μm□] | 175 [μm□] |
| Analysis region | 60 [μmϕ] | 8 [μmϕ] | 60 [μmϕ] |

TABLE 3

| | Film $A_1$ | | Film $A_2$ |
|---|---|---|---|
| Gas type and flow rate | | | |
| $SiH_4$ [mL/min(normal)] | 75 | Turn high-frequency power source OFF immediately and stop all source gases. Then, purge inside of reaction vessel five times with Ar. | 75 |
| $H_2$ [mL/min(normal)] | 0 | | 0 |
| $B_2H_6$ [ppm with respect to $SiH_4$] | 200 | | 0 |
| $CH_4$ [mL/min(normal)] | 75 | | 75 |
| NO [mL/min(normal)] | 0 | | 0 |

TABLE 3-continued

| | Film $A_1$ | | Film $A_2$ |
|---|---|---|---|
| High-frequency power [mW/cm$^3$] | 10 | 0 | 10 |
| Temperature of substrate [° C.] | 250 | 250 | 250 |
| Pressure in reaction vessel [Pa] | 25 | — | 25 |
| Layer thickness [μm] | 1 | — | 1 |

TABLE 4

| | Charging ability | Sensitivity | $\Delta Z/\Delta Z_0$ |
|---|---|---|---|
| Example 1 | 122 | 82 | 1.0 |
| Example 2 | 114 | 85 | 3.0 |
| Example 3 | 117 | 84 | 1.6 |
| Comparative Example 1 | 100 | 100 | 5.0 |
| Comparative Example 2 | 103 | 102 | 8.5 |

TABLE 5

| | Lower charge injection prohibiting layer | Photoconductive layer | Surface layer: Change region: Photoconductive layer-side portion | Upper charge injection prohibiting portion | | Surface-side portion | Surface-side region |
|---|---|---|---|---|---|---|---|
| Gas type and flow rate | | | | | | | |
| $SiH_4$ [mL/min(normal)] | 150 | 195 | 100→90 | 90→75 | 75 | 75→15 | 15 |
| $H_2$ [mL/min(normal)] | 300 | 1000 | 0 | 0 | 0 | 0 | 0 |
| $B_2H_6$ [ppm with respect to $SiH_4$] | 0 | 0 | 0 | 200 | Close inflow valve and outflow valve immediately. | 0 | 0 |
| $CH_4$ [mL/min(normal)] | 150 | 0 | 0→55 | 55→75 | 75 | 75→350 | 350 |
| NO [mL/min(normal)] | 10 | 0 | 0 | 0 | 0 | 0 | 0 |
| High-frequency power [mW/cm$^3$] | 10 | 17 | | 10 | | | 10 |
| Temperature of substrate [° C.] | 250 | 270 | | 250 | | | 250 |
| Pressure in reaction vessel [Pa] | 40 | 60 | | 25 | | | 25 |
| Layer thickness [μm] | 3 | 25 | | 0.7 | | | 0.5 |

TABLE 6

| | Lower charge injection prohibiting layer | Photoconductive layer | Surface layer: Change region: Photoconductive layer-side portion | Upper charge injection prohibiting portion | | Surface-side portion | Surface-side region |
|---|---|---|---|---|---|---|---|
| Gas type and flow rate | | | | | | | |
| $SiH_4$ [mL/min(normal)] | 150 | 195 | 100→90 | 90→75 | 75 | 75→15 | 15 |
| $H_2$ [mL/min(normal)] | 300 | 1000 | 0 | 0 | 5 | 5→0 | 0 |
| $B_2H_6$ [ppm with respect to $SiH_4$] | 0 | 0 | 0 | 200 | Close inflow valve and outflow valve immediately. | 0 | 0 |
| $CH_4$ [mL/min(normal)] | 150 | 0 | 0→55 | 55→75 | 75 | 75→350 | 350 |
| NO [mL/min(normal)] | 10 | 0 | 0 | 0 | 0 | 0 | 0 |
| High-frequency power [mW/cm$^3$] | 10 | 17 | | 10 | | | 10 |
| Temperature of substrate [° C.] | 250 | 270 | | 250 | | | 250 |
| Pressure in reaction vessel [Pa] | 40 | 60 | | 25 | | | 25 |
| Layer thickness [μm] | 3 | 25 | | 0.7 | | | 0.5 |

TABLE 7

| | Lower charge injection prohibiting layer | Photoconductive layer | Surface layer: Change region: Photoconductive layer-side portion | Surface layer: Change region: Upper charge injection prohibiting portion | Surface layer: Change region: Surface-side portion | Surface layer: Surface-side region |
|---|---|---|---|---|---|---|
| Gas type and flow rate | | | | | | |
| $SiH_4$ [mL/min(normal)] | 150 | 195 | 100→90 | 90→75 | 75→15 | 15 |
| $H_2$ [mL/min(normal)] | 300 | 1000 | 0 | 0 | 0 | 0 |
| $B_2H_6$ [ppm with respect to $SiH_4$] | 0 | 0 | 0 | 200 | 0 | 0 |
| $CH_4$ [mL/min(normal)] | 150 | 0 | 0→55 | 55→75 | 75→350 | 350 |
| NO [mL/min(normal)] | 10 | 0 | 0 | 0 | 0 | 0 |
| High-frequency power [mW/cm$^3$] | 10 | 17 | | 10 | | 10 |
| Temperature of substrate [° C.] | 250 | 270 | | 250 | | 250 |
| Pressure in reaction vessel [Pa] | 40 | 60 | | 25 | | 25 |
| Layer thickness [μm] | 3 | 25 | | 0.7 | | 0.5 |

As is apparent from Table 4, it has been found that the charging ability (charging ability when the photosensitive member is negatively electrified) and the luminous sensitivity of the a-Si photosensitive member are enhanced, when the precipitous property of the distribution of the Group 13 atom in the boundary portion between the surface-side portion 109 and the upper charge injection prohibiting portion 108 satisfies the relation expressed by the following expression (A7).

$$1.0 \leq \Delta Z/\Delta Z_0 \leq 3.0 \quad \text{(A7)}$$

The reason why the luminous sensitivity of the a-Si photosensitive member is enhanced is that the amount of an electric charge (negative charge) necessary for making the surface potential of the a-Si photosensitive member a predetermined value decreases, when the charging ability (charging ability when the photosensitive member is negatively electrified) of the a-Si photosensitive member is enhanced. In the above-described evaluation of the luminous sensitivity, a current value of a charging device (primary charging device) is adjusted so that a surface potential of the photosensitive member becomes −450 V (dark part potential). The current value at this time decreases, and the surface potential of the photosensitive member can be controlled to be a predetermined value even if the amount of the electric charge (negative charge) is small which is supplied to the surface of the photosensitive member.

Because of this, the amount of photocarriers to be formed can also be small, which becomes necessary next for setting the surface potential of the photosensitive member to −50 V (bright part potential). Specifically, the quantity of light of the irradiating laser can be small, which is considered, in other words, to mean that the luminous sensitivity of the photosensitive member is enhanced.

The precipitous property of the distribution of the Group 13 atom in the boundary portion between the surface-side portion 109 and the upper charge injection prohibiting portion 108 in Example 3 is more enhanced than that in Example 2, and the charging ability and the luminous sensitivity of the a-Si photosensitive member in Example 3 are more enhanced than those in Example 2.

The reason is considered as follows.

In Example 2, the inflow valve 7245 and the outflow valve 7255 of $B_2H_6$ are immediately closed, and the introduction of $B_2H_6$ into the reaction vessel 7110 is stopped. As a result, there is the case where the variation of the pressure occurs in the reaction vessel 7110. It is considered that there is the case where the precipitous property of the above-described Group 13 atom is lowered by the influence.

On the other hand, in Example 3, when the introduction of $B_2H_6$ into the reaction vessel 7110 was stopped, $H_2$ was simultaneously introduced into the reaction vessel 7110 at a flow rate equal to that of $B_2H_6$. Accordingly, it is considered that the variation of the pressure in the reaction vessel 7110 was suppressed and the above-described precipitous property of the Group 13 atom was enhanced.

Furthermore, the precipitous property of the distribution of the Group 13 atom in the boundary portion between the surface-side portion 109 and the upper charge injection prohibiting portion 108 in Example 1 is more enhanced than those in Examples 2 and 3, and the charging ability and the luminous sensitivity of the a-Si photosensitive member in Example 1 are more enhanced than those in Examples 2 and 3.

The reason is considered as follows.

In Example 2 and Example 3, the inflow valve 7245 and the outflow valve 7255 of $B_2H_6$ are immediately closed, and the introduction of $B_2H_6$ into the reaction vessel 7110 is stopped.

However, it is considered that $B_2H_6$ still remains in a pipe from the inflow valve 7245 to the reaction vessel 7110 and in a pipe from the reaction vessel 7110 to the outflow valve 7255, even though the inflow valve 7245 and the outflow valve 7255 have been closed. The remaining $B_2H_6$ can flow into the reaction vessel 7110 even after the inflow valve 7245 and the outflow valve 7255 have been closed. The high-frequency power is supplied during the time, and accordingly the deposition film is continuously formed.

On the other hand, in Example 1, the high-frequency power which is introduced into the reaction vessel 7110 is firstly stopped, and then the introduction of all the source gases into the reaction vessel 7110 is stopped. Subsequently, the gases in the reaction vessel 7110 are purged by Ar five times, and then the formation of the deposition film is restarted. In other words, the high-frequency power which is introduced into the reaction vessel 7110 is stopped, thereby the formation of the deposition film is stopped and the source gas is exchanged in the state. It is considered that the precipitous property of the above-described Group 13 atom is thereby enhanced.

Example 4

The a-Si photosensitive member was manufactured with similar procedures to those in Example 1.

However, in the present example, the upper charge injection prohibiting portion 108 was formed in the following way.

The upper charge injection prohibiting portion 108 in the change region 106 was formed in different positions, that is, a position at which the above-described ratio (C/(Si+C)) in the change region 106 was 0.00 to 0.10, a position at which the ratio was 0.10 to 0.20, a position at which the ratio was 0.20 to 0.30, a position at which the ratio was 0.25 to 0.35 and a position at which the ratio was 0.30 to 0.40.

In addition, in any case where the upper charge injection prohibiting portion 108 is formed in any position, the formation of the upper charge injection prohibiting portion 108 was completed (completion of the introduction of $B_2H_6$ into the reaction vessel 7110) in a similar way to that in Example 1, by turning the high-frequency power source 7120 OFF and stopping the high-frequency power which was introduced into the reaction vessel 7110 immediately when the formation of the upper charge injection prohibiting portion 108 was completed. After that, the introduction of all the source gases (including $B_2H_6$) into the reaction vessel 7110 was stopped.

$B_2H_6$ was introduced into the reaction vessel 7110 at such previously adjusted flow rates that the charging ability was maximized for each condition, and was introduced thereinto at the following flow rates.

When the upper charge injection prohibiting portion 108 was formed at the position at which the above-described ratio (C/(Si+C)) in the change region 106 was 0.00 to 0.10, the flow rate was 100 ppm with respect to $SiH_4$.

When the upper charge injection prohibiting portion 108 was formed at the position at which the above-described ratio (C/(Si+C)) in the change region 106 was 0.10 to 0.20, the flow rate was 200 ppm with respect to $SiH_4$.

When the upper charge injection prohibiting portion 108 was formed at the position at which the above-described ratio (C/(Si+C)) in the change region 106 was 0.20 to 0.30, the flow rate was 500 ppm with respect to $SiH_4$.

When the upper charge injection prohibiting portion 108 was formed at the position at which the above-described ratio (C/(Si+C)) in the change region 106 was 0.25 to 0.35, the flow rate was 800 ppm with respect to $SiH_4$.

When the upper charge injection prohibiting portion 108 was formed at the position at which the above-described ratio (C/(Si+C)) in the change region 106 was 0.30 to 0.40, the flow rate was 1000 ppm with respect to $SiH_4$.

After that, the gases in the reaction vessel 7110 were purged by Ar five times.

After that, the flow rate of $SiH_4$ was set at 75 [mL/min (normal)], and the flow rate of $CH_4$ was set at 75 [mL/min (normal)]. When the flow rates of $SiH_4$ and $CH_4$ and the internal pressure (pressure in the reaction vessel 7110) became stable, the introduction of the high-frequency power into the reaction vessel 7110 was restarted, and the formation of the change region 106 was started again.

Each manufactured a-Si photosensitive member was subjected to the evaluations of "charging ability" and "luminous sensitivity" in a similar way to those in Example 1. In addition, "precipitous property" was evaluated in the following way.

"Precipitous Property"

The middle position in an axial direction on the surface of the manufactured a-Si photosensitive member was subjected to the SIMS analysis in a similar way to that in Example 1. $f(D_S)$ and $\Delta Z$ were determined from the depth profile of the ionic strength of a Group 13 atom, which was obtained by the SIMS analysis.

Next, the standard laminated film A (film $A_1$ and film $A_2$) was produced in a similar way to that used when the a-Si photosensitive member of the present example was manufactured, in imitation of procedures of Example 1, and was subjected to the SIMS analysis on similar conditions to those in the case of the a-Si photosensitive member.

Then, the $f_S(D_S)$ and the $\Delta Z_0$ were determined from the depth profile of the ionic strength of the Group 13 atom, which was obtained by the SIMS analysis.

The obtained result is shown in Table 8.

TABLE 8

| Position at which upper charge injection prohibiting portion 108 is formed (C/(Si + C)) × 100 | Charging ability | $\Delta Z/\Delta Z_0$ |
|---|---|---|
| 0-10 | 125 | 1.0 |
| 10-20 | 122 | 1.0 |
| 20-30 | 115 | 1.0 |
| 25-35 | 107 | 1.0 |
| 30-40 | 105 | 1.0 |

As is apparent from Table 8, it has been found that concerning the position at which the upper charge injection prohibiting portion 108 is provided, the charging ability (charging ability when the photosensitive member is negatively electrified) is more enhanced in the case where the upper charge injection prohibiting portion 108 is provided in the portion at which the above-described ratio (C/(Si+C)) is more than 0.00 and 0.30 or less in the change region 106 than in the case where the upper charge injection prohibiting portion 108 is provided in the portion at which the ratio is more than 0.30.

The reason is considered as follows.

If the above-described ratio (C/(Si+C)) exceeds 0.30, the efficiency of making the Group 13 atom contained (doped) in the change region 106 is lowered. As a result, even if the upper charge injection prohibiting portion 108 is made to contain many Group 13 atoms, there is the case where the upper charge injection prohibiting portion 108 cannot effectively block an electric charge (negative charge) from being injected into the photoconductive layer 104 from the surface of the photosensitive member 100. For this reason, it is considered that there is the case where the charging ability (charging ability when the photosensitive member is negatively electrified) of the a-Si photosensitive member is not remarkably enhanced even if the precipitous property of the distribution of the Group 13 atom is enhanced in the boundary portion between the surface-side region 107 and the upper charge injection prohibiting portion 108.

In addition, it has been found from Table 8 that even if there are various upper charge injection prohibiting portions 108, the charging ability (charging ability when the photosensitive member is negatively electrified) of the a-Si photosensitive member is enhanced by using the standard laminated film A corresponding to each portion, evaluating the precipitous property of the distribution of the ionic intensity of the Group 13 atom in the boundary portion between the surface-side region 107 and the upper charge injection prohibiting portion 108, and making the precipitous property satisfy the relation expressed by the above-described formula (A7).

Example 5

An a-Si photosensitive member was manufactured with similar procedures to those in Example 1, except that conditions shown in Table 1 were changed to conditions shown in Table 9.

However, in the present example, the upper charge injection prohibiting portion 108 was formed in the following way.

In the conditions on which the change region 106 was formed, at the time when a flow rate of $SiH_4$ which was introduced into the reaction vessel 7110 became 90 [mL/min (normal)] and a flow rate of $CH_4$ became 55 [mL/min (normal)], the high-frequency power source 7120 was immediately turned OFF and the high-frequency power which was introduced into the reaction vessel 7110 was stopped.

After that, the introduction of all the source gases into the reaction vessel 7110 was stopped, and the gases in the reaction vessel 7110 were purged by Ar five times.

After that, the flow rate of $SiH_4$ which was introduced into the reaction vessel 7110 was set at 90 [mL/min (normal)], the flow rate of $CH_4$ was set at 55 [mL/min (normal)] and the flow rate of $B_2H_6$ was set at 200 Ppm with respect to $SiH_4$. When the flow rates of $SiH_4$, $CH_4$ and $B_2H_6$ and the internal pressure (pressure in the reaction vessel 7110) became stable, the introduction of the high-frequency power into the reaction vessel 7110 was restarted, and the formation of the change region 106 was started again.

After that, a deposition film was formed while the flow rate of $B_2H_6$ was maintained at 200 ppm with respect to $SiH_4$.

After that, in the conditions on which the change region 106 was formed, at the time when the flow rate of $SiH_4$ which was introduced into the reaction vessel 7110 became 75 [mL/min (normal)] and when the flow rate of $CH_4$ became 75 [mL/min (normal)], the high-frequency power source 7120 was immediately turned OFF, and the high-frequency power which was introduced into the reaction vessel 7110 was stopped.

After that, the introduction of all the source gases into the reaction vessel 7110 was stopped, and the gases in the reaction vessel 7110 were purged by Ar five times.

After that, the flow rate of $SiH_4$ which was introduced into the reaction vessel 7110 was set at 75 [mL/min (normal)], and the flow rate of $CH_4$ was set at 75 [mL/min (normal)]. When the flow rates of $SiH_4$ and $CH_4$ and the internal pressure (pressure in the reaction vessel 7110) became stable, the introduction of the high-frequency power into the reaction vessel 7110 was restarted, and the formation of the change region 106 was started again.

The manufactured a-Si photosensitive member was subjected to the evaluations of "charging ability" and "luminous sensitivity" in a similar way to those in Example 1. In addition, "precipitous property" was evaluated by the precipitous property ΔY of the distribution of the Group 13 atom in the boundary portion (boundary) between the surface layer 105 (specifically the upper charge injection prohibiting portion 108 in the change region 106 in the surface layer 105) and the photoconductive layer 104, which was evaluated in the following way.

"Precipitous Property"

The middle position in an axial direction on the surface of the manufactured a-Si photosensitive member was subjected to the SIMS analysis in a similar way to that in Example 1. The $g(E_S)$ and the ΔY were determined from the depth profile of the ionic strength of the Group 13 atom, which was obtained by the SIMS analysis.

Furthermore, compositions of the hydrogen atom, the carbon atom and the silicon atom were determined at the position at which the ionic strength of the Group 13 atom became $g(E_{50})$, and as a result, the compositions were as follows: hydrogen atom=19.4 atom %, carbon atom=8.6 atom %, and silicon atom=71.9 atom %.

Next, the standard laminated film B (film $B_1$ and film $B_2$) was produced in a similar way to that used when the a-Si photosensitive member of the present example was manufactured, in imitation of procedures of Example 1.

Specifically, the standard laminated film B (film $B_1$ and film $B_2$) was produced on the surface of the conductive substrate (substrate) 7112 which was made from aluminum and had a cylindrical shape with a diameter of 84 mm, a length of 381 mm and a wall thickness of 3 mm, with the use of the apparatus 7000 for forming a deposition film illustrated in FIG. 7, on conditions shown in Table 11, in a similar way to that in the manufacture of the a-Si photosensitive member.

Specifically, after the film $B_1$ was formed, the high-frequency power source 7120 was immediately turned OFF, and the high-frequency power which was introduced into the reaction vessel 7110 was stopped.

After that, the introduction of all the source gases into the reaction vessel 7110 was stopped, and the gases in the reaction vessel 7110 were purged by Ar five times.

After that, source gases for forming the film $B_2$ were introduced into the reaction vessel 7110, as is shown in Table 11. When the flow rates of the source gases and the internal pressure (pressure in the reaction vessel 7110) became stable, the high-frequency power was introduced into the reaction vessel 7110, and the film $B_2$ was formed on the film $B_1$.

The produced standard laminated film B was subjected to the SIMS analysis on similar conditions to those in the case of the above-described a-Si photosensitive member.

Compositions of the hydrogen atom, the carbon atom and the silicon atom were determined in the standard laminated film B, and as a result, the compositions of the standard laminated film B (film $B_1$ and film $B_2$) were as follows: hydrogen atom=19.6 atom %, carbon atom=9.0 atom %, and silicon atom=71.4 atom %. In other words, the compositions were equal to those of the hydrogen atom, the carbon atom and the silicon atom at the position at which the ionic strength of the Group 13 atom became $g(E_{50})$ on the above-described a-Si photosensitive member.

Then, $g_S(E_{SS})$ and $\Delta Y_0$ were determined from the depth profile of the ionic strength of the Group 13 atom, which was obtained by the SIMS analysis.

As a result, the ratio was $\Delta Y/\Delta Y_0=1.0$.

Incidentally, in the present example, $\Delta Z/\Delta Z_0$ was determined in imitation of Example 1. As a result, the ratio was $\Delta Z/\Delta Z_0=1.0$. In addition, in Example 1, $\Delta Y/\Delta Y_0$ was determined in imitation of the present example. As a result, the ratio was $\Delta Y/\Delta Y_0=9.5$.

The obtained result is shown in Table 12.

Example 6

An a-Si photosensitive member was manufactured with similar procedures to those in Example 1, except that conditions shown in Table 1 were changed to conditions shown in Table 10.

However, in the present example, the upper charge injection prohibiting portion 108 was formed in the following way.

In the conditions on which the change region 106 was formed, at the time when a flow rate of $SiH_4$ which was introduced into the reaction vessel 7110 became 90 [mL/min (normal)] and when a flow rate of $CH_4$ became 55 [mL/min (normal)], the flow rate of $B_2H_6$ which was introduced into the reaction vessel 7110 was rapidly increased to 200 ppm with respect to $SiH_4$ with the use of a mass flow controller.

After that, a deposition film was formed while the flow rate of $B_2H_6$ was maintained at 200 ppm with respect to $SiH_4$.

After that, in the conditions on which the change region 106 was formed, at the time when the flow rate of $SiH_4$ which was introduced into the reaction vessel 7110 became 75 [mL/min (normal)] and when the flow rate of $CH_4$ became 75 [mL/min (normal)], the high-frequency power source 7120 was immediately turned OFF, and the high-frequency power which was introduced into the reaction vessel 7110 was stopped.

After that, the introduction of all the source gases into the reaction vessel 7110 was stopped, and the gases in the reaction vessel 7110 were purged by Ar five times.

After that, the flow rate of $SiH_4$ which was introduced into the reaction vessel 7110 was set at 90 [mL/min (normal)], and the flow rate of $CH_4$ was set at 55 [mL/min (normal)]. When the flow rates of $SiH_4$ and $CH_4$ and the internal pressure (pressure in the reaction vessel 7110) became stable, the introduction of the high-frequency power into the reaction vessel 7110 was restarted, and the formation of the change region 106 was started again.

The manufactured a-Si photosensitive member was subjected to the evaluations of "charging ability" and "luminous sensitivity" in a similar way to those in Example 5. In addition, "precipitous property" was evaluated in the following way.

"Precipitous Property"

The middle position in an axial direction on the surface of the manufactured a-Si photosensitive member was subjected to the SIMS analysis in a similar way to that in Example 5. $g(E_S)$ and $\Delta Y$ were determined from the depth profile of the ionic strength of the Group 13 atom, which was obtained by the SIMS analysis.

Furthermore, compositions of the hydrogen atom, the carbon atom and the silicon atom were determined at the position at which the ionic strength of the Group 13 atom became $g(E_{50})$, and as a result, the compositions were as follows: hydrogen atom=19.4 atom %, carbon atom=8.8 atom %, and silicon atom=71.7 atom %.

Next, the standard laminated film B (film $B_1$ and film $B_2$) was produced in a similar way to that used when the a-Si photosensitive member of the present example was manufactured, in imitation of procedures of Example 5, and was subjected to the SIMS analysis on similar conditions to those in the case of the a-Si photosensitive member.

Then, $g_S(E_{SS})$ and $\Delta Y_0$ were determined from the depth profile of the ionic strength of the Group 13 atom, which was obtained by the SIMS analysis.

As a result, the ratio was $\Delta Y/\Delta Y_0=2.8$.

Incidentally, in the present example, $\Delta Z/\Delta Z_0$ was determined in imitation of Example 1. As a result, the ratio was $\Delta Z/\Delta Z_0=1.0$.

The obtained result is shown in Table 12.

TABLE 9

| | | | Surface layer | | | | | |
|---|---|---|---|---|---|---|---|---|
| | | | Change region | | | | | |
| | Lower charge injection prohibiting layer | Photoconductive layer | Photoconductive layer-side portion | | Upper charge injection prohibiting portion | | Surface-side portion | Surface-side region |
| Gas type and flow rate | | | | | | | | |
| $SiH_4$ [mL/min(normal)] | 150 | 195 | 100→90 | Turn high-frequency power source OFF immediately and stop all source gases. Then, purge inside of reaction vessel five times with Ar. | 90→75 | Turn high-frequency power source OFF immediately and stop all source gases. Then, purge inside of reaction vessel five times with Ar. | 75→15 | 15 |
| $H_2$ [mL/min(normal)] | 300 | 1000 | 0 | | 0 | | 0 | 0 |
| $B_2H_6$ [ppm with respect to $SiH_4$] | 0 | 0 | 0 | | 200 | | 0 | 0 |
| $CH_4$ [mL/min(normal)] | 150 | 0 | 0→55 | | 55→75 | | 75→350 | 350 |
| NO [mL/min(normal)] | 10 | 0 | 0 | | 0 | | 0 | 0 |
| High-frequency power [mW/cm$^3$] | 10 | 17 | 10 | 0 | 10 | 0 | 10 | 10 |
| Temperature of substrate [° C.] | 250 | 270 | 250 | | | | | 250 |
| Pressure in reaction vessel [Pa] | 40 | 60 | 25 | | | | | 25 |
| Layer thickness [μm] | 3 | 25 | 0.7 | | | | | 0.5 |

TABLE 10

| | Lower charge injection prohibiting layer | Photoconductive layer | Surface layer | | | | | |
|---|---|---|---|---|---|---|---|---|
| | | | Change region | | | | | |
| | | | Photoconductive layer-side portion | | Upper charge injection prohibiting portion | | Surface-side portion | Surface-side region |
| Gas type and flow rate | | | | | | | | |
| $SiH_4$ [mL/min(normal)] | 150 | 195 | 100→90 | 90 | 90→75 | Turn high-frequency power source OFF immediately and stop all source gases. Then, purge inside of reaction vessel five times with Ar. | 75→15 | 15 |
| $H_2$ [mL/min(normal)] | 300 | 1000 | 0 | 0 | 0 | | 0 | 0 |
| $B_2H_6$ [ppm with respect to $SiH_4$] | 0 | 0 | 0 | Increase flow rate rapidly from 0 to 200. | 200 | | 0 | 0 |
| $CH_4$ [mL/min(normal)] | 150 | 0 | 0→55 | 55 | 55→75 | | 75→350 | 350 |
| NO [mL/min(normal)] | 10 | 0 | 0 | 0 | 0 | | 0 | 0 |
| High-frequency power [mW/cm$^3$] | 10 | 17 | 10 | 10 | 10 | 0 | 10 | 10 |
| Temperature of substrate [° C.] | 250 | 270 | | | 250 | | | 250 |
| Pressure in reaction vessel [Pa] | 40 | 60 | | | 25 | | | 25 |
| Layer thickness [μm] | 3 | 25 | | | 0.7 | | | 0.5 |

TABLE 11

| | Film $B_1$ | | Film $B_2$ |
|---|---|---|---|
| Gas type and flow rate | | | |
| $SiH_4$ [mL/min(normal)] | 90 | Turn high-frequency power source OFF immediately and stop all source gases. Then, purge inside of reaction vessel five times with Ar. | 90 |
| $H_2$ [mL/min(normal)] | 0 | | 0 |
| $B_2H_6$ [ppm with respect to $SiH_4$] | 0 | | 200 |
| $CH_4$ [mL/min(normal)] | 55 | | 55 |
| NO [mL/min(normal)] | 0 | | 0 |
| High-frequency power [mW/cm$^3$] | 10 | 0 | 10 |
| Temperature of substrate [° C.] | 250 | 250 | 250 |
| Pressure in reaction vessel [Pa] | 25 | — | 25 |
| Layer thickness [μm] | 1 | — | 1 |

TABLE 12

| | Charging ability | Sensitivity | $\Delta Z/\Delta Z_0$ | $\Delta Y/\Delta Y_0$ |
|---|---|---|---|---|
| Example 1 | 122 | 82 | 1.0 | 9.5 |
| Example 5 | 132 | 81 | 1.0 | 1.0 |
| Example 6 | 128 | 82 | 1.0 | 2.8 |

As is apparent from Table 12, it has been found that the charging ability (charging ability when the photosensitive member is negatively electrified) of the a-Si photosensitive member is enhanced by making the precipitous property of the distribution of the Group 13 atom in the boundary portion (boundary) between the surface layer 105 (the upper charge injection prohibiting portion 108 in the change region 106 in the surface layer 105) and the photoconductive layer 104 satisfy the relation expressed by the following expression (B7).

$$1.0 \leq \Delta Y/\Delta Y_0 \leq 3.0 \quad \text{(B7)}$$

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-033648, filed Feb. 22, 2013, which is hereby incorporated by reference herein in its entirety.

What is claimed is:

1. An electrophotographic photosensitive member to be negatively electrified, comprising: a conductive substrate; a photoconductive layer which is formed from hydrogenated amorphous silicon on the conductive substrate; and a surface layer which is formed from hydrogenated amorphous silicon carbide on the photoconductive layer, wherein the surface layer has a change region in which a ratio (C/(Si+C)) of the number of carbon atoms (C) with respect to the sum of the number of silicon atoms (Si) and the number of carbon atoms (C) gradually increases toward a surface side of the electrophotographic photosensitive member from a side of the photoconductive layer, the change region has an upper charge injection prohibiting portion containing a Group 13 atom, and a surface-side portion which is positioned closer to the surface side of the electrophotographic photosensitive member than the upper charge injection prohibiting portion and does not contain the Group 13 atom, and when a precipitous property of the distribution of the Group 13 atom in a boundary portion between the surface-side portion and the upper charge injection prohibiting portion is evaluated with a following evaluation method A, the precipitous property satisfies a relation expressed by a following expression (A7), wherein the evaluation method A of the precipitous property of the distribution of the Group 13 atom comprises the following steps of:

(A1) obtaining a depth profile of a surface of the electrophotographic photosensitive member by an SIMS analysis;

(A2) making D represent a distance from the surface of the electrophotographic photosensitive member, in the depth profile, making a function f(D) of the distance D represent an ionic strength of the Group 13 atom at the distance D, making $f(D_{MAX})$ represent a maximal value of f(D), making f"(D) represent a second order differential of f(D), making $D_A$ represent a distance of a point at which when the D is increased toward the photoconductive layer, f"(D) changes from f"(D)=0 to f"(D)<0, from the surface of the electrophotographic photosensitive member, and making $D_B$ represent a distance of a point at which f"(D) subsequently changes from f"(D)<0 to f"(D)=0, from the surface of the electrophotographic photosensitive member;

(A3) making $D_S$ represent a first distance among the distances D which satisfy $f((D_A+D_B)/2)\geq f(D_{MAX})\times 0.5$, when the upper charge injection prohibiting portion is viewed from the surface of the electrophotographic photosensitive member, and making a standard ionic strength $f(D_S)$ represent the ionic strength f(D) of the Group 13 atom at the distance $D_S$;

(A4) making a precipitous property ΔZ represent a length in a thickness direction of the boundary portion, in which the ionic strength of the Group 13 atom in the boundary portion between the surface-side portion and the upper charge injection prohibiting portion increases from 16% to 84%, when viewed from the surface of the electrophotographic photosensitive member and when the standard ionic strength $f(D_S)$ is determined to be 100%;

(A5) producing a standard laminated film A which has a film $A_1$ that has a composition corresponding to the upper charge injection prohibiting portion and a film $A_2$ that has a composition corresponding to the surface-side portion, stacked in this order;

(A6) determining a surface of the film $A_2$ as a surface of the standard laminated film A with respect to the standard laminated film A, and determining a precipitous property $\Delta Z_0$ in the boundary portion between the film $A_2$ and the film $A_1$ of the standard laminated film A, with similar steps to the steps (A1) to (A4); and (A7)

determining $1.0\leq\Delta Z/\Delta Z_0\leq 3.0$ (A7).

2. The electrophotographic photosensitive member according to claim 1, wherein the upper charge injection prohibiting portion is provided in a portion in which the ratio (C/(Si+C)) of the number of the carbon atoms (C) with respect to the sum of the number of the silicon atoms (Si) and the number of the carbon atoms (C) in the change region is more than 0.00 and 0.30 or less.

3. The electrophotographic photosensitive member according to claim 1, wherein when a precipitous property of the distribution of the Group 13 atom in a boundary portion between the upper charge injection prohibiting portion and the photoconductive layer in a case where the upper charge injection prohibiting portion is a portion closest to the side of the photoconductive layer in the surface layer or in a boundary portion between the upper charge injection prohibiting portion and a photoconductive layer-side portion in a case where the change region has the photoconductive layer-side portion that is positioned closer to the side of the photoconductive layer than the upper charge injection prohibiting portion is evaluated with a following evaluation method B, the precipitous property satisfies a relation expressed by a following expression (B7), wherein the evaluation method B of the precipitous property of the distribution of the Group 13 atom comprises the following steps of:

(B1) obtaining a depth profile of the surface of the electrophotographic photosensitive member by an SIMS analysis;

(B2) making E represent a distance from a boundary portion between the photoconductive layer or photoconductive layer-side portion and the upper charge injection prohibiting portion, in the depth profile, making a function g(E) of the distance E represent an ionic strength of the Group 13 atom at the distance E, making g"(E) represent a second order differential of g(E), making $g(E_{MAX})$ represent a maximal value of g(E), making $E_A$ represent a distance of a point at which when E is increased toward the surface of the electrophotographic photosensitive member, g"(E) changes from g"(E)=0 to g"(E)<0, from the boundary portion between the photoconductive layer or the photoconductive layer-side portion and the upper charge injection prohibiting portion, and making $E_B$ represent a distance of a point at which g"(E) changes from g" (E)<0 to g" (E)=0, from the boundary portion between the photoconductive layer or the photoconductive layer-side portion and the upper charge injection prohibiting portion;

(B3) making $E_S$ represent a first distance among the distances E which satisfy $g((E_A+E_B)/2)\geq g(E_{MAX})\times 0.5$, when the upper charge injection prohibiting portion is viewed from the boundary portion between the photoconductive layer or the photoconductive layer-side portion and the upper charge injection prohibiting portion, and making a standard ionic strength $g(E_S)$ represent the ionic strength g(E) of the Group 13 atom at the distance $E_S$;

(B4) making a precipitous property ΔY represent a length in a thickness direction of the boundary portion, in which the ionic strength of the Group 13 atom in the boundary portion between the photoconductive layer or the photoconductive layer-side portion and the upper charge injection prohibiting portion increases from 16% to 84%, when viewed from the boundary portion between the photoconductive layer or the photoconductive layer-side portion and the upper charge injection prohibiting portion and when the standard ionic strength $g(E_S)$ is determined to be 100%;

(B5) producing a standard laminated film B which has a film $B_1$ that has a composition corresponding to the photoconductive layer or the photoconductive layer-side portion and a film $B_2$ that has a composition corresponding to the upper charge injection prohibiting portion, stacked in this order;

(B6) determining a surface of the film $B_2$ as a surface of the standard laminated film B with respect to the standard laminated film B, and determining a precipitous property $\Delta Y_0$ in a boundary portion between the film $B_2$ and the film $B_1$ of the standard laminated film B, with similar steps to the steps (B1) to (B4); and (B7)

determining $1.0 \leq \Delta Y/\Delta Y_0 \leq 3.0$ (B7).

4. The electrophotographic photosensitive member according to claim 1, wherein the Group 13 atom is a boron atom.

5. The electrophotographic photosensitive member according to claim 1, wherein the electrophotographic photosensitive member has a lower charge injection prohibiting layer between the conductive substrate and the photoconductive layer.

6. The electrophotographic photosensitive member according to claim 5, wherein the lower charge injection prohibiting layer is a layer formed from hydrogenated amorphous silicon.

7. The electrophotographic photosensitive member according to claim 5, wherein the lower charge injection prohibiting layer contains a Group 15 atom.

8. The electrophotographic photosensitive member according to claim 7, wherein the Group 15 atom is a nitrogen atom.

9. A method for manufacturing the electrophotographic photosensitive member according to claim 1, comprising:

installing the conductive substrate in an inner part of a reaction vessel which can be depressurized; introducing a source gas into the inner part of the reaction vessel; introducing a high-frequency power into the inner part of the reaction vessel to excite the source gas; and forming the photoconductive layer and the surface layer on the conductive substrate in this order, wherein the forming the change region in the surface layer comprises:

introducing source gases for forming the upper charge injection prohibiting portion into the inner part of the reaction vessel, and introducing the high-frequency power into the inner part of the reaction vessel to form the upper charge injection prohibiting portion;

then, stopping the introduction of the source gases for forming the upper charge injection prohibiting portion into the inner part of the reaction vessel and the introduction of the high-frequency power into the inner part of the reaction vessel; and then, in a state in which the introduction of a source gas for supplying the Group 13 atom is stopped among the source gases for forming the upper charge injection prohibiting portion into the inner part of the reaction vessel, introducing other source gases into the inner part of the reaction vessel at a same flow rate as a flow rate before stopping the introduction, and introducing the high-frequency power into the inner part of the reaction vessel at a same value as a value before stopping the introduction to form the surface-side portion.

10. A method for manufacturing the electrophotographic photosensitive member according to claim 1, comprising:

installing the conductive substrate in an inner part of a reaction vessel which can be depressurized; introducing source gases into the inner part of the reaction vessel; introducing a high-frequency power into the inner part of the reaction vessel to excite the source gases; and forming the photoconductive layer and the surface layer on the conductive substrate in this order, wherein the forming the change region in the surface layer comprises:

introducing source gases for forming the upper charge injection prohibiting portion into the inner part of the reaction vessel, and introducing the high-frequency power into the inner part of the reaction vessel to form the upper charge injection prohibiting portion; and then, immediately stopping the introduction of a source gas for supplying the Group 13 atom among the source gases for forming the upper charge injection prohibiting portion into the inner part of the reaction vessel, and keeping on introducing other source gases into the inner part of the reaction vessel and introducing the high-frequency power into the inner part of the reaction vessel to form the surface-side portion.

11. A method for manufacturing the electrophotographic photosensitive member according to claim 1, comprising:

installing the conductive substrate in an inner part of a reaction vessel which can be depressurized; introducing source gases into the inner part of the reaction vessel; introducing a high-frequency power into the inner part of the reaction vessel to excite the source gases; and forming the photoconductive layer and the surface layer on the conductive substrate in this order, wherein the forming the change region in the surface layer comprises:

introducing source gases for forming the upper charge injection prohibiting portion into the inner part of the reaction vessel, and introducing the high-frequency power into the inner part of the reaction vessel to form the upper charge injection prohibiting portion; and then, immediately stopping the introduction of a source gas for supplying the Group 13 atom among the source gases for forming the upper charge injection prohibiting portion into the inner part of the reaction vessel, keeping on introducing other source gases into the inner part of the reaction vessel and introducing the high-frequency power into the inner part of the reaction vessel, and introducing hydrogen into the inner part of the reaction vessel at a same flow rate as a flow rate of the source gas for supplying the Group 13 atom before stopping the introduction to form the surface-side portion.

12. An electrophotographic apparatus comprising the electrophotographic photosensitive member according to claim 1, a charging device, an image exposure device, a developing device and a transfer device.

* * * * *